US010995509B2

(12) United States Patent
Cordes

(10) Patent No.: US 10,995,509 B2
(45) Date of Patent: May 4, 2021

(54) METHODS AND SYSTEMS FOR PROVIDING LIGHTWEIGHT ACOUSTICALLY SHIELDED ENCLOSURES

(71) Applicant: Marc Cordes, Arlington, VA (US)

(72) Inventor: Marc Cordes, Arlington, VA (US)

( * ) Notice: Subject to any disclaimer, the term of this patent is extended or adjusted under 35 U.S.C. 154(b) by 0 days.

(21) Appl. No.: 16/049,636

(22) Filed: Jul. 30, 2018

(65) Prior Publication Data

US 2019/0063098 A1 Feb. 28, 2019

Related U.S. Application Data

(60) Provisional application No. 62/539,515, filed on Jul. 31, 2017, provisional application No. 62/666,710, filed on May 4, 2018, provisional application No. 62/671,433, filed on May 18, 2018.

(51) Int. Cl.

| | |
|---|---|
| ***E04H 9/00*** | (2006.01) |
| ***H04K 1/00*** | (2006.01) |
| ***G10K 11/162*** | (2006.01) |
| ***G10K 11/175*** | (2006.01) |
| ***E04H 9/10*** | (2006.01) |

(52) U.S. Cl.

CPC ..... *E04H 9/00* (2013.01); *E04H 9/10* (2013.01); *G10K 11/162* (2013.01); *G10K 11/175* (2013.01); *H04K 1/00* (2013.01)

(58) Field of Classification Search

CPC ..... E04H 9/00; G10K 11/175; G10K 11/162; H04K 1/00

USPC ..... 342/4, 5

See application file for complete search history.

(56) References Cited

U.S. PATENT DOCUMENTS

| | | | | |
|---|---|---|---|---|
| 5,134,405 | A * | 7/1992 | Ishihara | G01R 29/105 342/1 |
| 5,353,029 | A * | 10/1994 | Johnston | H01Q 17/00 342/1 |
| 6,011,504 | A * | 1/2000 | Tan | H05K 9/0001 174/379 |
| 6,308,644 | B1 * | 10/2001 | Diaz | E05G 5/003 109/6 |
| 6,870,092 | B2 * | 3/2005 | Lambert | H05K 9/0041 174/355 |
| 7,117,640 | B2 * | 10/2006 | Hurzeler | E06B 5/18 49/501 |
| 2006/0011054 | A1 * | 1/2006 | Walthall, III | F42D 5/045 86/50 |
| 2006/0080897 | A1 * | 4/2006 | O'Neal | E04H 9/06 52/1 |
| 2007/0002547 | A1 * | 1/2007 | Garmong | H05K 9/0001 361/752 |
| 2009/0071322 | A1 * | 3/2009 | Oxford | F41H 3/00 89/36.02 |
| 2012/0292095 | A1 * | 11/2012 | Cordes | H05K 9/0001 174/378 |
| 2014/0008119 | A1 * | 1/2014 | Brandt | H05K 9/0073 174/382 |

* cited by examiner

*Primary Examiner* — Joshua K Ihezie

(74) *Attorney, Agent, or Firm* — Capitol Patent & Trademark Law Firm, PLLC

(57) ABSTRACT

Lightweight shielded enclosures and systems provide a high level of acoustic, RF, EMI and EMP protection. Such enclosures and systems include one or more lightweight, non-conductive beams arranged to support a shielded covering.

10 Claims, 39 Drawing Sheets

METHODS AND SYSTEMS FOR PROVIDING LIGHTWEIGHT ACOUSTICALLY SHIELDED ENCLOSURES

RELATED APPLICATIONS

This application claims the benefit of priority from U.S. Provisional Patent Application No. 62/539,515 filed Jul. 31, 2017 ("'515 application"), U.S. Provisional Application No. 62/666,710 filed May 4, 2018 ("710 application") and U.S. Provisional Application No. 62/671,433 filed May 15, 2018 ("'433 application"). The application is also related to U.S. patent application Ser. No. 13/471,401 ("'401 application"), U.S. Provisional Application No. 62/531,312 (the '312 application) and U.S. Provisional Application No. 62/531,317 (the '317 application). The present application incorporates by reference herein the entire disclosures of the '515, '710, '433, '401, 312 and 317 applications as if such disclosures were set forth in full herein.

INTRODUCTION

Keeping communications secret from an adversary or competitor has long been the challenge of the military, agencies of the federal government as well companies that are targets of corporate espionage. The challenge becomes even more difficult when communications are made from locations that do not have structures that have been built to prevent eavesdropping and the like, such as when a member of the presidential cabinet, foreign service or military travels to a foreign country, works in an embassy built by some other country or travels to a locale within the United States that is not considered secure from a communications point of view. Further, when secret or secure communications are required on the battlefield or in battlefield-like conditions a secure structure may be difficult to construct.

Secure enclosures that protect against acoustical eavesdropping, electromagnetic interference (EMI) and radio frequency interference (RF) have been in operation for more than fifty years. Typically, these enclosures are made of rigid metal panels, beams and doors and are typically prefabricated and shipped to a site where they require a number of skilled experts to erect. More recently, shielded tents that can be transported in cases and quickly erected were introduced. Still, these tents require the use of a heavy support structures, integrated power and signal filters, waveguide vents, environmental control units (e.g., blowers, air conditioners, heaters). These tents are also bulky and require many transport cases for shipment and deployment.

Accordingly, it is desirable to provide extremely lightweight and secure enclosures that provide an increased level of acoustic, EMI/RF, Electromagnetic pulse (EMP) and infrared protection (i.e., attenuation) compared to existing enclosures while overcoming the problems associated with the existing enclosures.

SUMMARY

The present invention provides various methods and systems for providing lightweight, enclosures and enclosure systems that provide a high level of acoustic, EMI/RF, Electromagnetic pulse (EMP) and infrared attenuation/protection. One such system may comprise: a lightweight inner shielded enclosure and a lightweight outer shielded enclosure, wherein the inner enclosure may comprise a plurality of lightweight, non-conductive beams forming an inner frame, the beams configured to support a first, lightweight shielded covering, wherein the weight of the first covering is distributed over the frame to reduce forces on the first covering, and the outer enclosure may comprise a plurality of lightweight, non-conductive beams forming an outer frame, the beams configured to support a second, lightweight shielded covering, wherein the weight of the second covering is distributed over the outer frame to reduce forces on the second covering.

The system may also comprise a lightweight closure system (e.g., a door).

The first and second coverings may each comprise a one-piece shielded covering, where a level of attenuation provided by the first, lightweight shielded covering may be the same as, or different than, the level of attenuation provided by the second, lightweight shielded covering.

Further, each of the coverings may comprise one or more layers configured to attenuate one or more EMI, RF, EMP and/or infrared signals. Yet further, one or both of the enclosures may comprise a ballistic layer supported by its respective frame.

In additional embodiments, one or both enclosures may comprise a plurality of passive sound attenuation panels supported by a respective frame, wherein each passive sound attenuation panel comprises one or more layers of acoustical absorbing or reflective material. Still further, one or both enclosures (or the system itself) may further comprise an active, acoustical masking system.

It should be understood that in addition to the system described above, the present invention provides for systems that include more than two enclosures or just one enclosure. Such a single enclosure may comprise a plurality of lightweight, non-conductive beams forming a frame, the beams configured to support a lightweight shielded covering (e.g., a one-piece covering), wherein the weight of the covering is distributed over the frame to reduce the forces on the covering, and a lightweight closure system, for example.

Similar to before, the enclosure may comprise an active, acoustical masking system and/or a plurality of passive sound attenuation panels supported by the frame, wherein each passive sound attenuation panel comprises one or more layers of acoustical absorbing or reflective material.

In an embodiment, one or more layers of the covering may be configured to attenuate one or more EMI, RF, EMP and/or infrared signals, and, in particular one layer may be configured to provide a level of attenuation for a given signal (e.g., RF signal, RF frequency) that is different than the level of protection provided by another level.

In addition to the layers just described the exemplary enclosure may also include one or more ballistic layers supported by the frame.

BRIEF DESCRIPTION OF THE DRAWINGS

FIG. 8A depicts a system comprising a plurality of removable panels according to an embodiment of the invention, while

DETAILED DESCRIPTION OF THE INVENTION, WITH EXAMPLES

Figure 1:
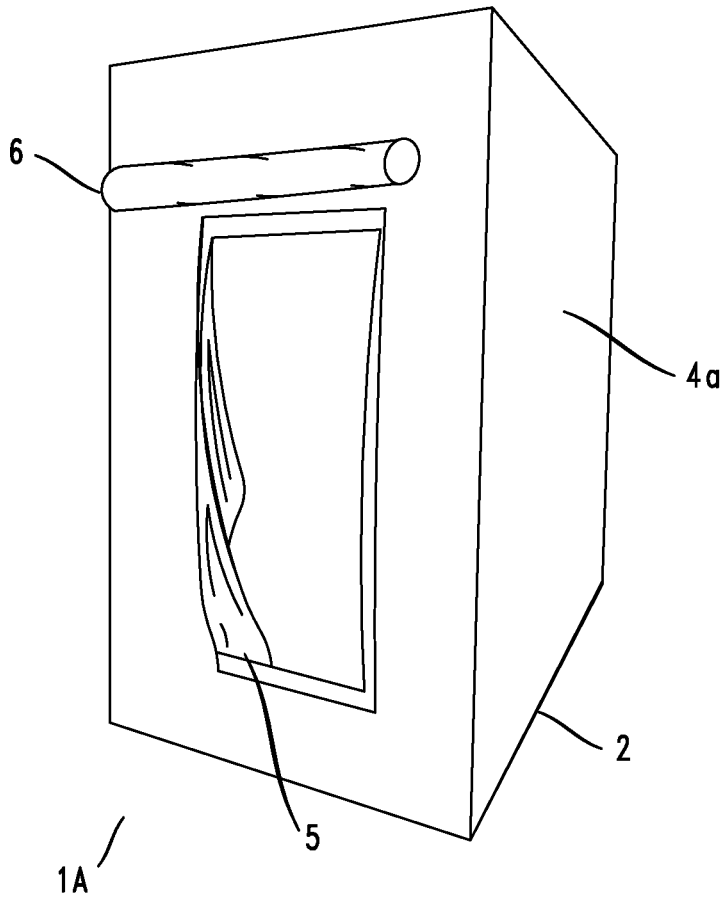
FIG. 1 depicts a system that includes a lightweight shielded enclosure according to an embodiment of the invention.

Exemplary embodiments of methods and systems for providing lightweight, shielded enclosures are described herein. Although specific exemplary embodiments are discussed herein, there is no intent to limit the scope of the present invention to such embodiments. To the contrary, the exemplary embodiments discussed herein are for illustrative purposes. Modified and alternative embodiments may be implemented without departing from the scope of the present invention. Said another way, the exemplary embodiments presented herein are only some of the many that fall within the scope of the present invention, it being practically impossible for the inventors to describe all the many possible exemplary embodiments and variations that fall within the scope of the present invention.

It should also be understood that one or more exemplary embodiments may be described as a process or method. Although a process/method may be described as sequential, such a process/method may be performed in parallel, concurrently or simultaneously. In addition, the order of each step within a process/method may be re-arranged. A process/method may be terminated when completed and may also include additional steps not included in a description of the process/method.

As used herein, the term "and/or" includes all combinations of one or more of the associated listed items. As used herein, the singular forms "a," "an" and "the" are intended to include the plural form, unless the context and/or common sense indicates otherwise. It should be further understood that the terms "comprises", "comprising,", "includes" and/or "including", when used herein, specify the presence of stated features, systems, subsystems, steps, operations, elements, and/or components, but do not preclude the presence or addition of one or more other features, systems, subsystems, steps, operations, elements, components, and/or combinations thereof.

As used herein, the designations "first", "second", etc., is purely to distinguish one component (e.g., element, component, side, etc.,) or part of a process from another and does not indicate an importance, priority or status. In fact, the component or parts of a process could be re-designated (i.e., re-numbered) and it would not affect the operation of the enclosures or methods provided by the present invention.

Yet further, when one part of a system is described or depicted as being connected to another part using "a connection" (or single line in a figure) it should be understood that practically speaking such a connection (line) may comprise (and many times will comprise) more than one physical connection.

It should be noted that the systems and methods illustrated in the figures are not drawn to scale, are not representative of an actual shape or size and are not representative of any actual enclosure, system, layout, manufacture's drawing or visual. Rather, the systems are drawn to simply help explain the features, functions and processes of exemplary embodiments of the present invention described herein and covered by the claims set forth at the end of this description. Similarly, it should be noted that the dimensions, shapes, designs, performance, and positions described herein and/or shown in the figures herein, are merely exemplary, and may be changed to fit a specific application/use/environment.

As used herein, the term "embodiment" or "exemplary" refers to one example of the present invention.

As used herein the phrase "operable to" means "functions to".

As used herein the phrase "shielded" means attenuating or preventing (collectively "attenuating") acoustic, EMI/RF (including millimeter wave), EMP and/or infrared signals over a range of frequencies from penetrating and the phrase "covering" means a covering that may comprise one or more layers that are woven together or otherwise connected to form a covering that can be installed as one element of an inventive system described herein. Thus, a shielded covering is a covering that attenuates acoustic, EMI, RF, EMP and/or infrared signals over a range of frequencies. Similarly, passive sound attenuation material, passive sound attenuation panels or similar phrases are material/panels that attenuate acoustical signals over a wide range of frequencies and levels (e.g., to 40 dB). When used herein "one-piece" means an integral, continuous piece such as a "one-piece" shielded covering that, while it may contain many layers in one dimension (i.e., vertically) it is configured as a single, integral and continuous piece in a second dimension (i.e., horizontally).

Referring now to FIG. 1, there is shown a system 1A that includes a lightweight shielded enclosure 2 according to an embodiment of the invention. The enclosure 2 consists of a multi-beam frame 3 (not shown in FIG. 1A, but see FIGS. 2D, 2I, 3A, 3B, 9A and 9D for example) comprising lightweight, non-conductive beams that are arranged as a support structure. The multi-beam frame 3 may support a light-weight shielded covering 4*a*, such as a one-piece covering for example, for attenuating EMI/RF, EMP and/or infrared signals over a wide-range of frequencies. It should be understood that, for the sake of simplicity, the shielded covering 4*a* is not shown in some of the Figures herein. Nonetheless each of the embodiments of the enclosures discussed herein may include a light-weight, one-piece shielded covering that is supported by, and rests on, the frame 3. The enclosure 2 includes an opening 5 that may be sealed by a closure system 6 (e.g., shielded fabric, or glidable wall disclosed in the '312 Application). The system 1A may further include means for connecting the enclosure 2 to a power, signal and air circulation control systems (not shown in FIG. 1).

In embodiments of the invention, the enclosure 2 may comprise a one-piece shielded covering 4*a*. In addition the enclosure 2 may include one or more removable and adjustable (collectively "removable") shielded panels or layers of a passive sound attenuation material for attenuating (reducing) the decibel level of sounds that are emitted from, or attempt to penetrate into, the interior of the system 1A. In an embodiment, the panels or layers of the passive sound attenuation material may be placed over the one-piece covering 4*a* (not shown in FIG. 1). In addition, the system 1A may further comprise an active, electronic acoustical (sound) masking system (not shown in Figures) that may, for example, generate signals at one or more frequencies to mask any sound emitted from, or permitted to penetrate into, the interior of the system 1A. For example, one or more vibratory elements that function to emit sound at one or more frequencies may be embedded or otherwise may a part of a layer of the enclosure 2 (and any other system and associated enclosures described herein). Alternatively, the passive and active elements may be combined to form a layered, sound attenuation and masking sub-system, for example.

In embodiments, the one-piece covering 4*a* (and all other one-piece coverings described herein) may be configured to rest upon the top, sides and bottom of a frame (described further herein) without the need to fasten the covering to the frame using straps or other connection devices. Accordingly, such inventive coverings function to distribute the force created by its weight over the entire area of the top and sides portions of the frame greatly reducing the stresses or forces that would be normally placed upon specific portions of the covering by, for example, hanging the covering from a frame using such straps. The reduction of such stresses to such specific portions further reduces the potential for such portions to rip or form openings near the straps which could result in signals from the outside penetrating into an enclosure or vice-versa, signals from the inside leaking out. In sum, the systems provided by the present invention include coverings that are configured to substantially reduce the ability of unwanted external signals from penetrating its enclosures and substantially reduce the ability of sensitive internal signals (e.g., communications, device operations) from escaping its enclosures.

An exemplary covering 4*a* may comprise one or more layers of a shielded, lightweight material (e.g., fabric) that is configured to attenuate one or more EMI, RF, EMP and/or infrared signals (e.g. 70 dB to 80 dB of attenuation of a 1 GHz signal, for example; attenuates other signals from 10 kHz to 20 GHz). In addition, the level of attenuation provided by each layer configured to attenuate RF signals, for example, may be different or the same. In an embodiment of the invention, an additional "ballistic", layer (e.g., nylon cover) may be included (not shown in figures) as a part of enclosure 2 and may be supported by a respective frame.

Figure 2B:
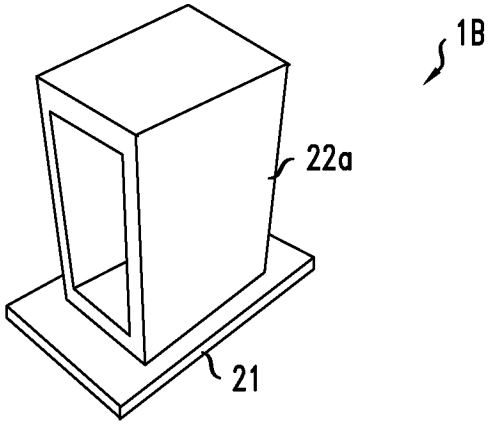
FIGS. 2A through 2K depict elements of an exemplary system according to an embodiment of the invention.
Figure 2D:
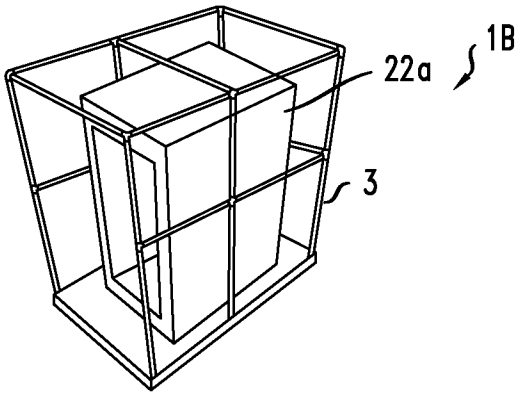
Figure 2A:
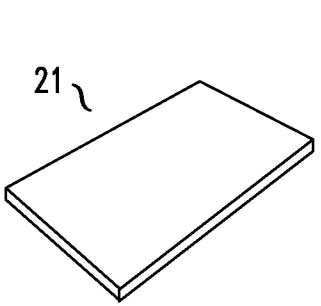
Figure 2C:
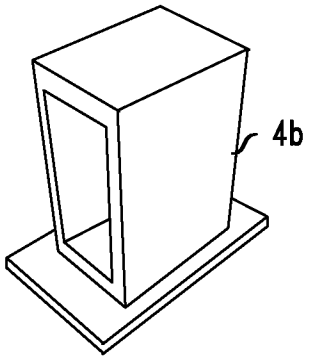

FIGS. 2A through 2H illustrate the elements of another exemplary system 1B according to embodiment of the invention. System 1B comprises both an inner shielded enclosure 22*a* and outer shielded enclosure 22*b* where it should be understood that the level of acoustic attenuation (passive or active), ballistic protection, and/or EMI, RF, EMP and/or infrared shielding (attenuation) may be the same for each enclosure 22*a*, 22*b* or may be different (e.g., the inner enclosure may attenuate one of EMI, RF, EMP or infrared signals, more than the outer enclosure, or less than the outer enclosure). In FIG. 2A, a floor element 21 that may be part of the second enclosure is depicted, while in FIG. 2B the inner shielded enclosure 22*a* is shown placed over the floor element 21. In an embodiment, the floor element 21 may be laid out and the inner shielded enclosure 22*a* placed on top over the floor element 21. The inner and outer shielded enclosures 22*a*,22*b* may be the type of enclosure described herein or in the '401 application, for example. After the inner shielded enclosure 22*a* has been positioned, one or more removable acoustic, shielded barriers or panels (collectively "panels" or "removable panels") making up a layer 4*b* (or layers) for providing passive sound attenuation and/or attenuating EMI, RF, EMP and/or infrared signals may be installed (see FIG. 2C). In FIG. 2D a multi-beam frame 3 for the second shielded enclosure 22*b* for providing support for one or more shielded layers described herein (e.g., a multi-layered covering) may be installed.

Figure 2E:
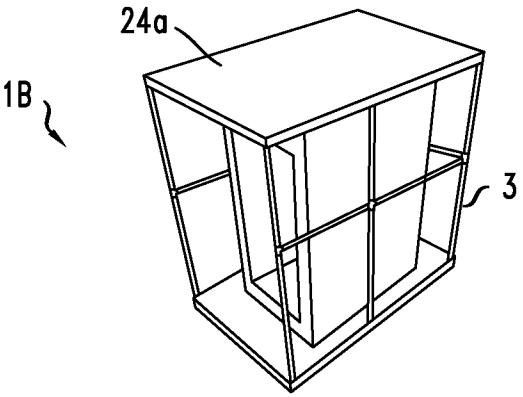
Figure 2F:
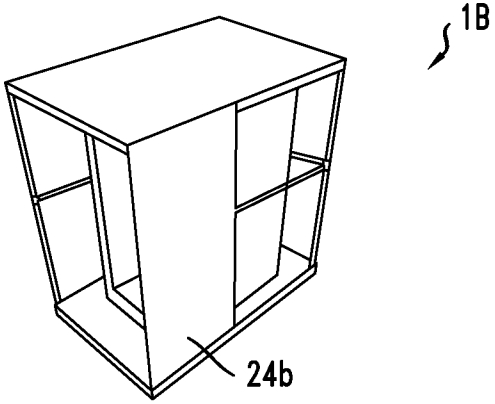
Figure 2G:
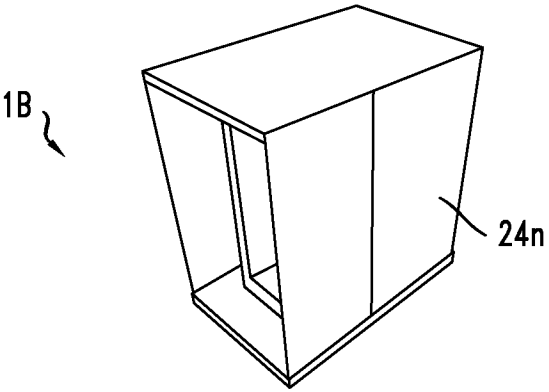
Figure 2H:
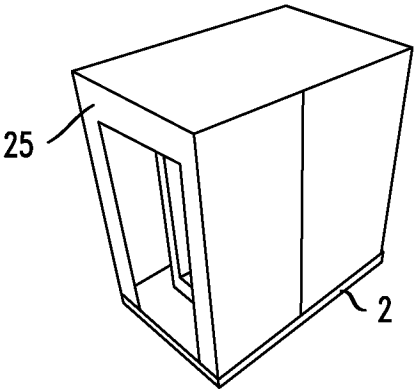

FIGS. 2E through 2G depict the addition of removable, shielded panels 24*a* to *n* (where "*n*" represents the last panel) comprising one or more layers, to the frame 3. Alternatively, instead of the panels 24*a* to *n*, a one-piece shielded covering may function to cover the frame 3. The panels may be of the type described in the '312 and/or '317 Application and the covering may comprise a one-piece fabric described in the '401 application, for example. FIG. 2H depicts the addition of a door panel 25. The panel 25 may be of the type described in the '312 and/or '317 Application or a door that provides passive acoustical attenuation of sound signals and/or attenuation of EMI, RF, EMP and/or infrared signals, for example. Once all the panels or covering is installed the second enclosure 22*b* in FIG. 2H may resemble the enclosure 22*a* depicted in FIG. 1.

In addition to shielded coverings, shielded layers and shielded panels, systems provided by the present invention may include one or more insulating layers configured between an outer surface of an inner enclosure (e.g., enclosure 22*a*) and an inner surface of an outer enclosure (e.g., enclosure 22*b*). Accordingly, such inventive systems function to provide electrical isolation between so-configured enclosures that, in turn, functions to provide a layered system of protection against attempts to penetrate such systems by EMI, RF, EMP and/or infrared signals.

Figure 2I:
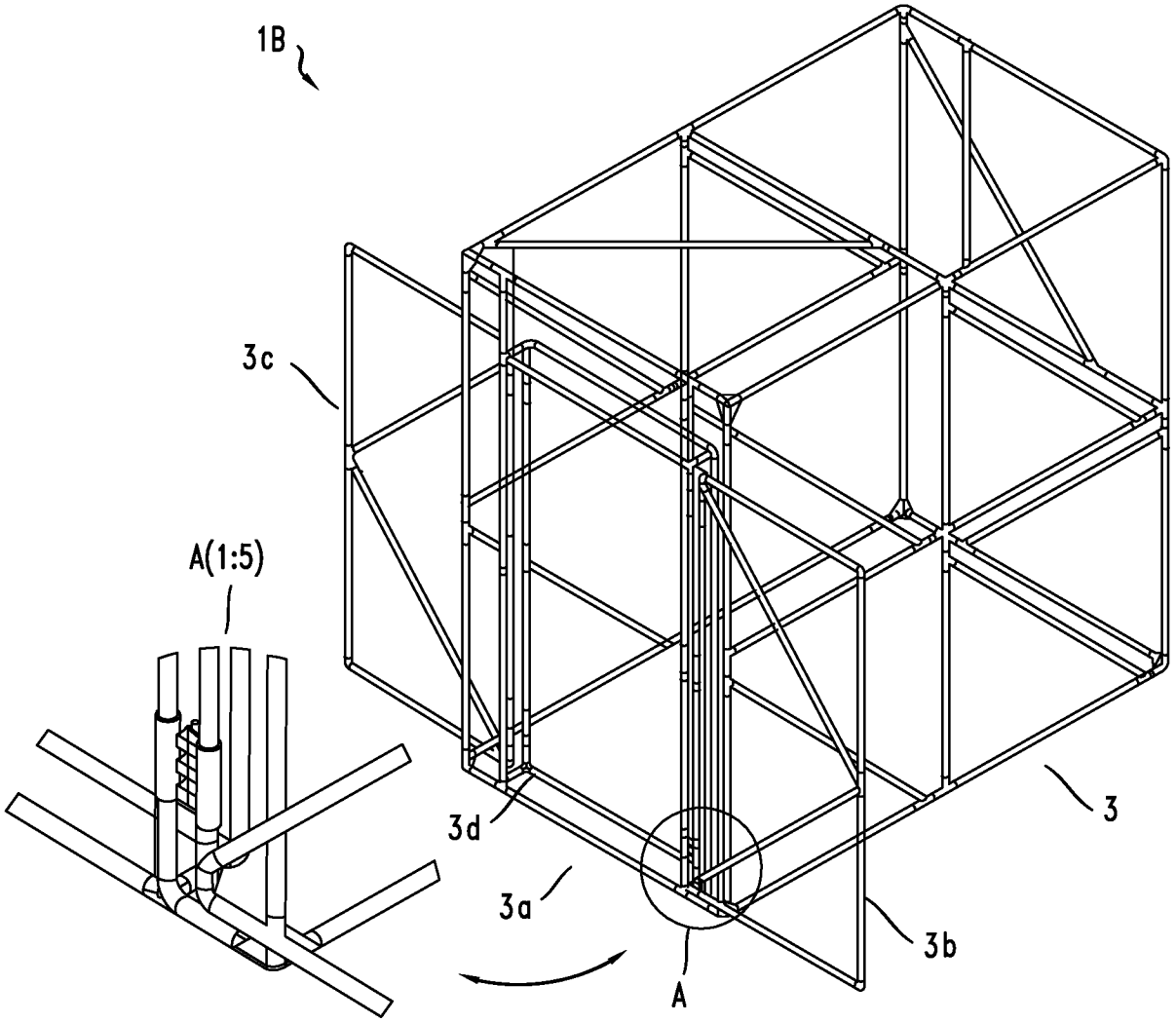
Figure 2K:
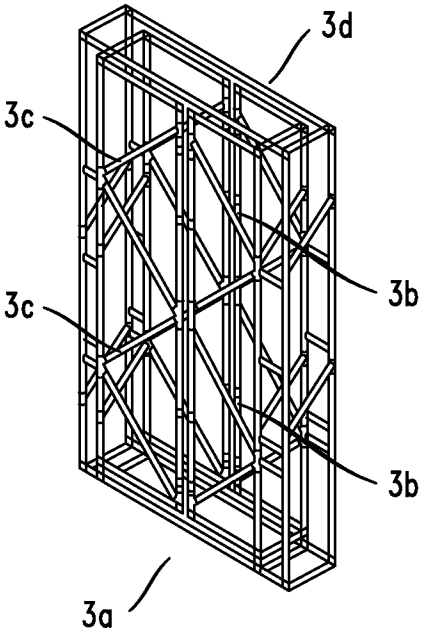
Figure 2J:
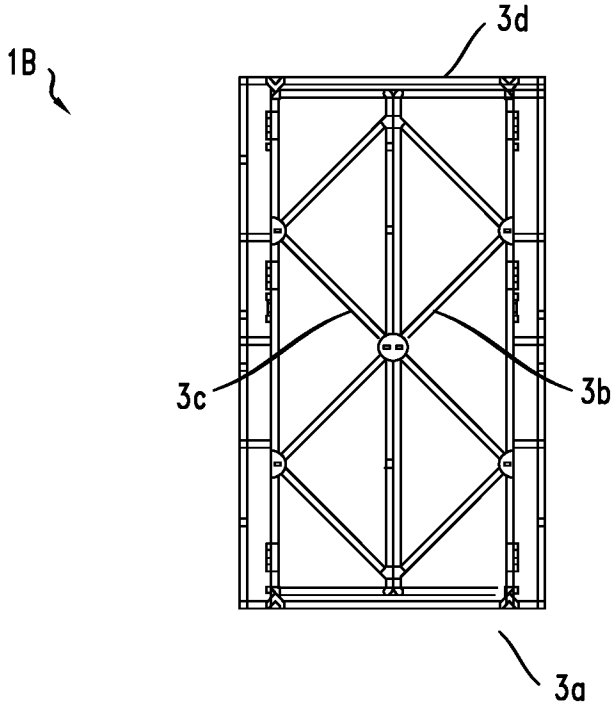

Referring now to FIG. 2I there is depicted another exemplary frame 3 that may include a lightweight vestibule or secondary passageway 3*a*. The vestibule 3*a* may be connected to the frame 3 as shown in insert "A" which is an expanded view of one connection point. The vestibule 3*a* may comprise side sections 3*b*,3*c* and a middle section 3*d*, each section comprised of lightweight non-conductive beams. In an embodiment, the side sections 3*b*,3*c* may be configured to form a door. In the embodiment shown in FIG. 2I, the door formed by side sections 3*b*,3*c* is in an "open" position. In FIGS. 2J and 2K the vestibule 3*a* is depicted as including side sections 3*b*,3*c* and middle section 3*d*, where the side sections form a door in the "closed" position.

It should be understood that the dimensions and sizes shown in FIGS. 1 and 2A through 2K, as well as the dimensions and sizes shown in all of the Figures herein, are exemplary, and may be changed to fit a specific application/use/environment. For example, the systems 1A, 1B and enclosures 2, 22*a*, 22*b* depicted in FIGS. 1 and 2A to 2L may be enlarged such as shown in FIGS. 3A, 3B, 4, 9A, 9D to 9F, 11D and 11E.

Figure 3A:
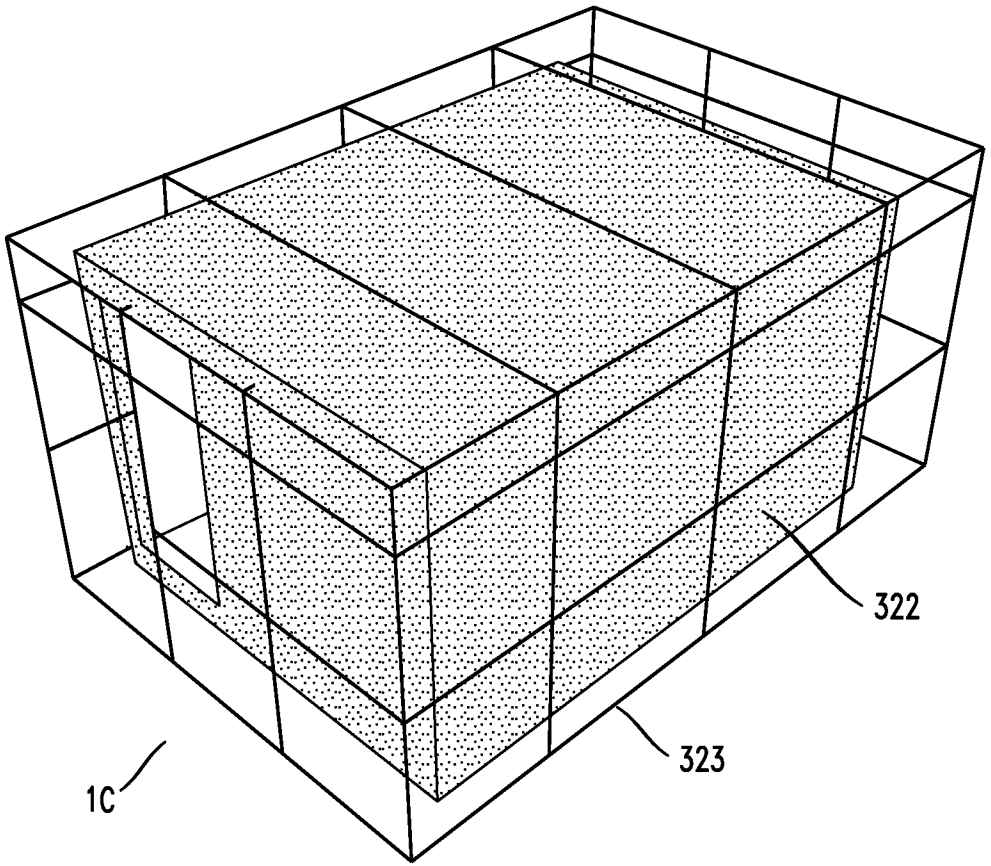
FIGS. 3A and 3B depict another version of an exemplary system according to an embodiment of the invention.
Figure 3B:
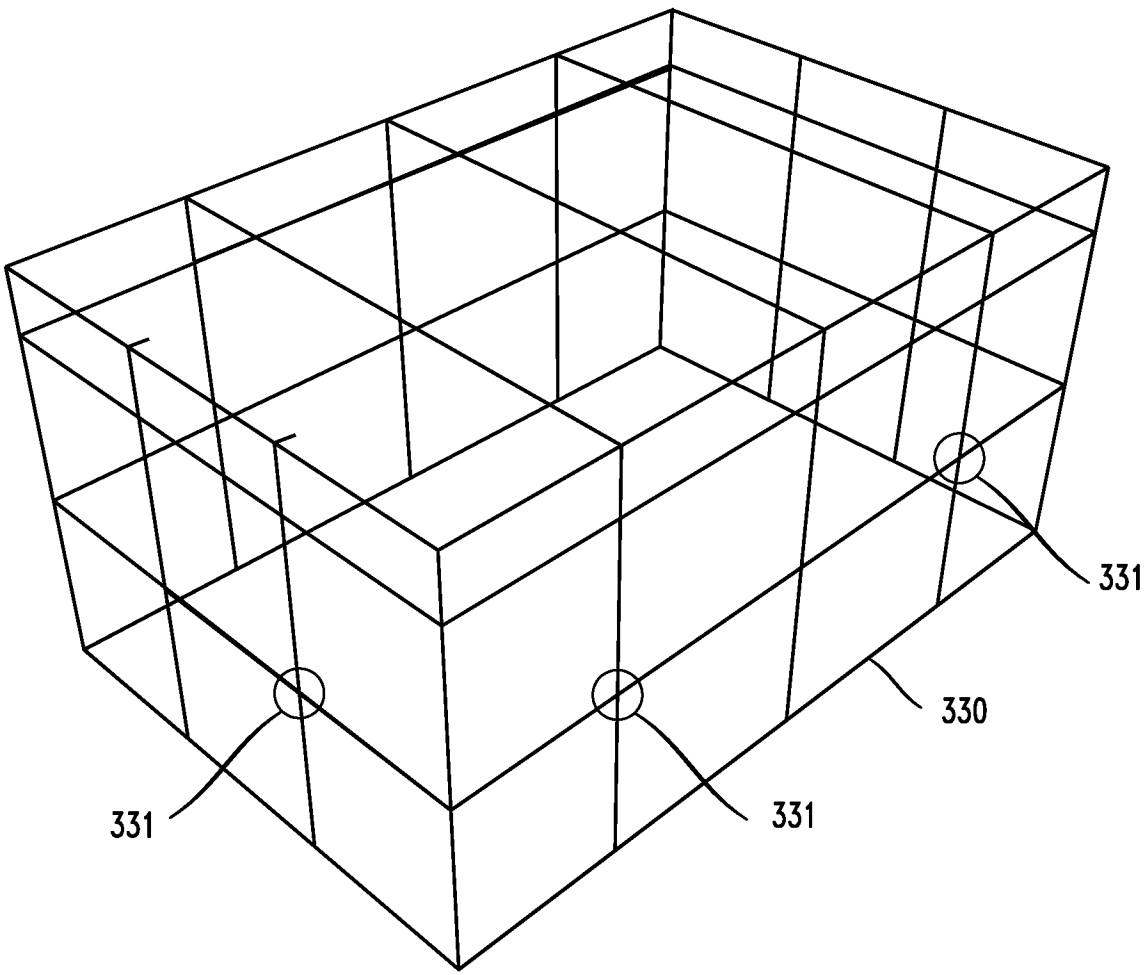

In FIG. 3A a system 1C is shown comprising an inner enclosure 322 and outer multi-beam frame 323 that may be part of a second enclosure. In an embodiment, the inner enclosure 322 may comprise the same features and materials as enclosure 22*a* shown in FIG. 2D (but larger) while the multi-beam frame 323 may comprise the same type of frame as frame 3 shown in FIG. 2D, for example (but larger, and with more beams). Another frame similar to frame 323 is shown in FIG. 3B as frame 330. It should be understood that the multi-beam frames 323,330 (and any frame described herein) may include, or be covered by, one or more layers of a passive sound attenuation material for reducing the level of a sound that is emitted from, or permitted to penetrate into, the interior of an enclosure formed by the multi-beam frame

323,330 and its covering (not shown in FIG. 3B). The covering of the multi-beam frame 323,330 (and any frame described herein) may additionally comprise a one-piece, multilayered shielded fabric that results in the attenuation of EMI, RF, EMP and/or infrared signals (e.g. 70 dB to 80 dB of attenuation of a 1 GHz signal, for example, attenuates other signals from 10 kHz to 20 GHz as well). Yet further, the level of attenuation provided by each layer configured to attenuate RF signals, for example, may be different (one layer attenuates a set of frequencies by an amount that is more than another layer attenuating the same, or different frequencies). In an embodiment of the invention, an additional "ballistic", nylon cover that is used in many traditional tent-like shielded enclosures may be used over the frames 323,330 as well.

In embodiments of the invention described herein, the inventive one-piece coverings may further comprise one or more layers of a weather-resistant fabric, for example, to withstand weather conditions such as rain, snow, wind and various temperature ranges.

Still further, it should be understood that the system 1C in FIG. 3A, as well as any system described herein, may comprise an active, electronic acoustical masking system (e.g., vibratory elements) that may, for example, generate signals at one or more frequencies to mask any sound emitted from, or permitted to penetrate into, the interior of the system 1C. The passive and active elements of system 1C may be combined to form a layered, acoustical attenuation and masking sub-system, for example.

Figure 4:
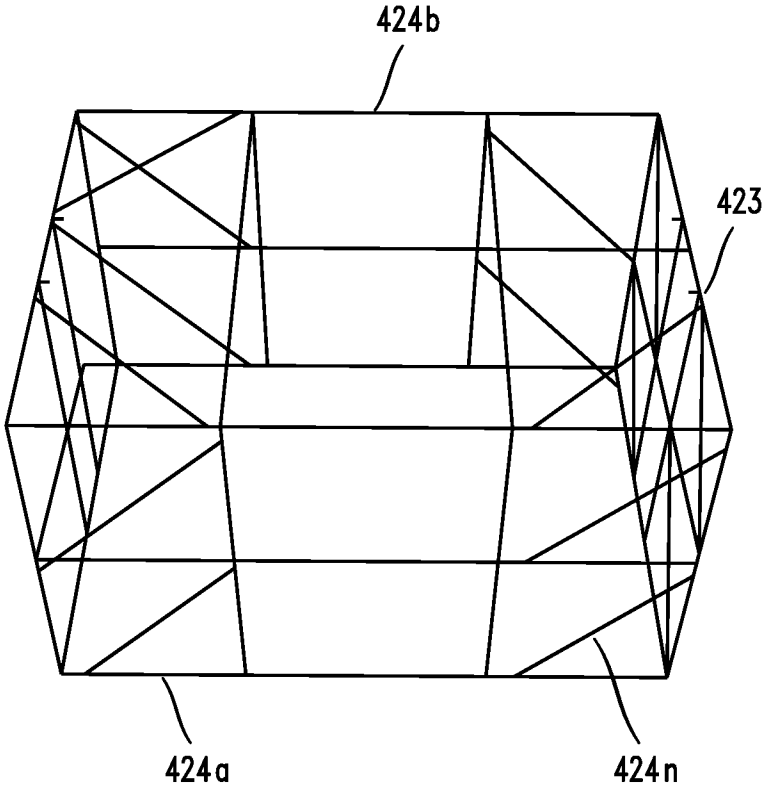
FIG. 4 depicts an exemplary multi-beam frame according to an embodiment of the invention.
Figure 9A:
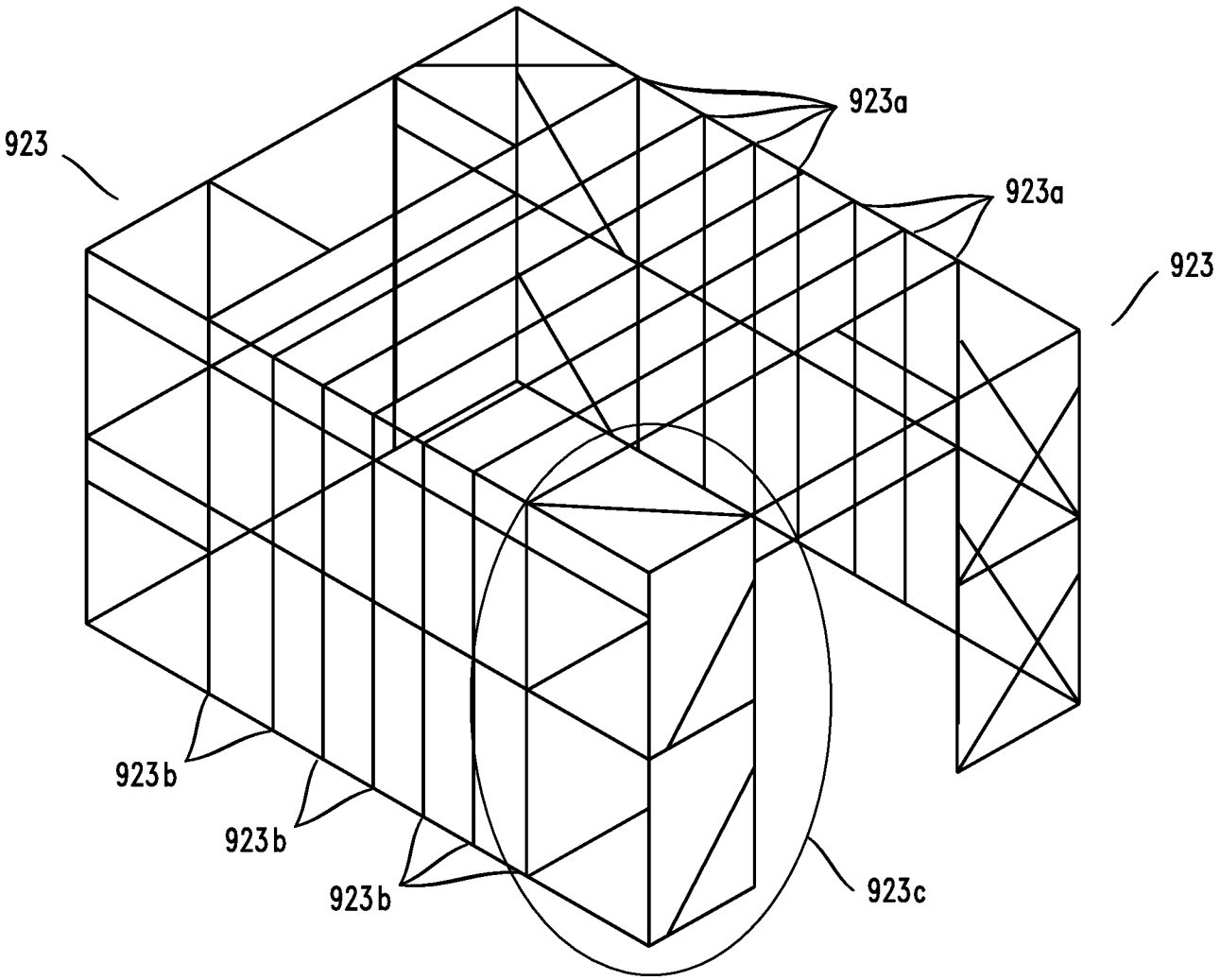
FIGS. 9A through 9C depict embodiments of a multi-beam, inner enclosure according to embodiments of the invention.
Figure 9B:
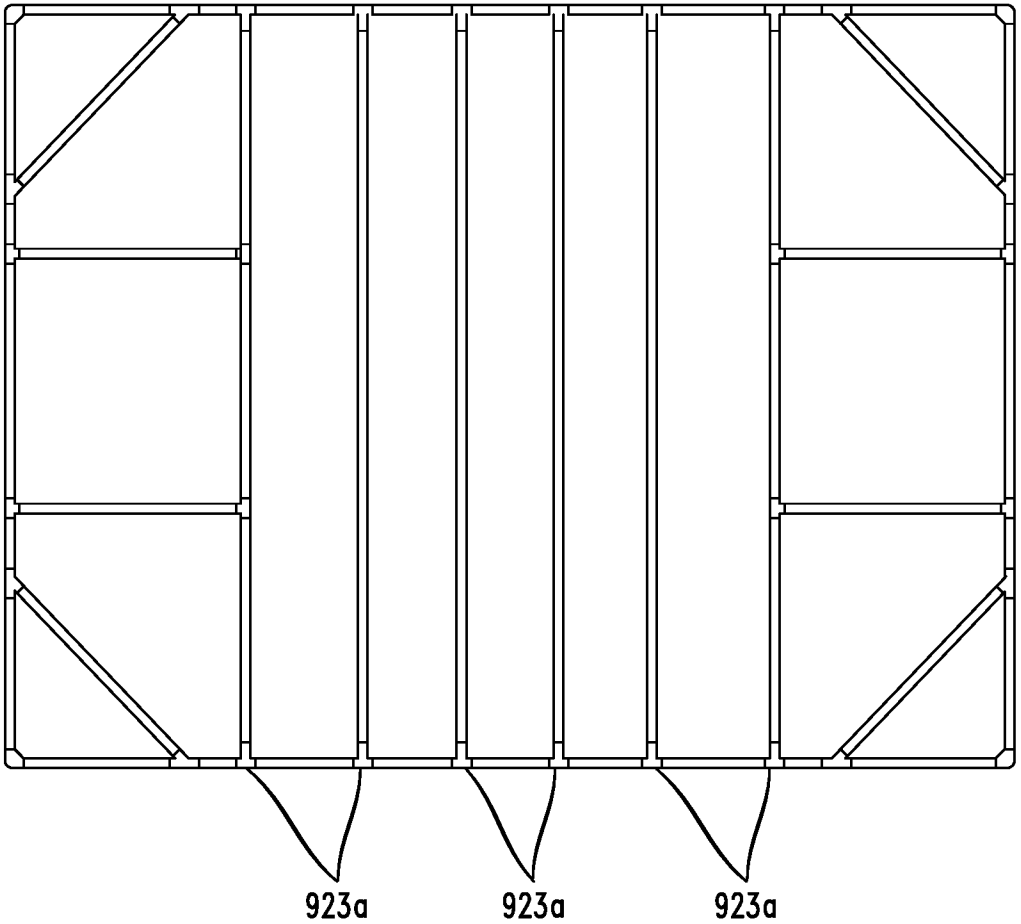
Figure 9C:
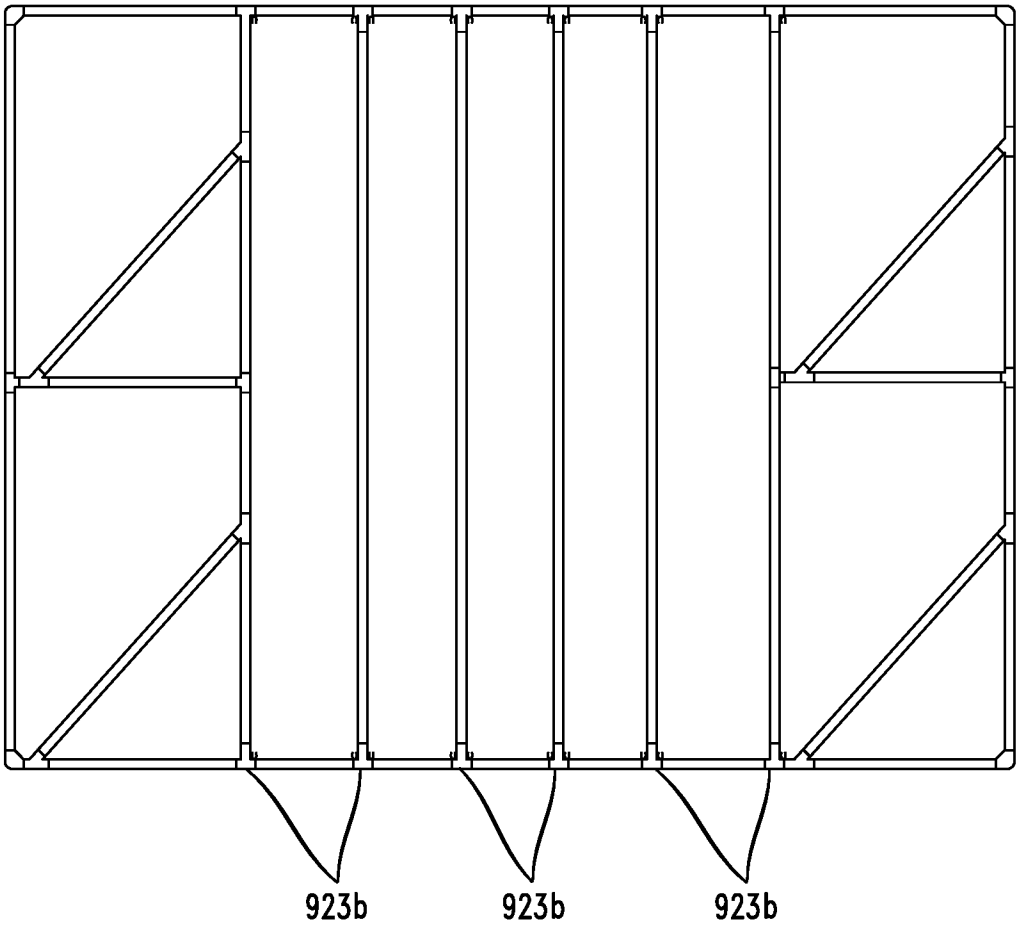
Figure 9D:
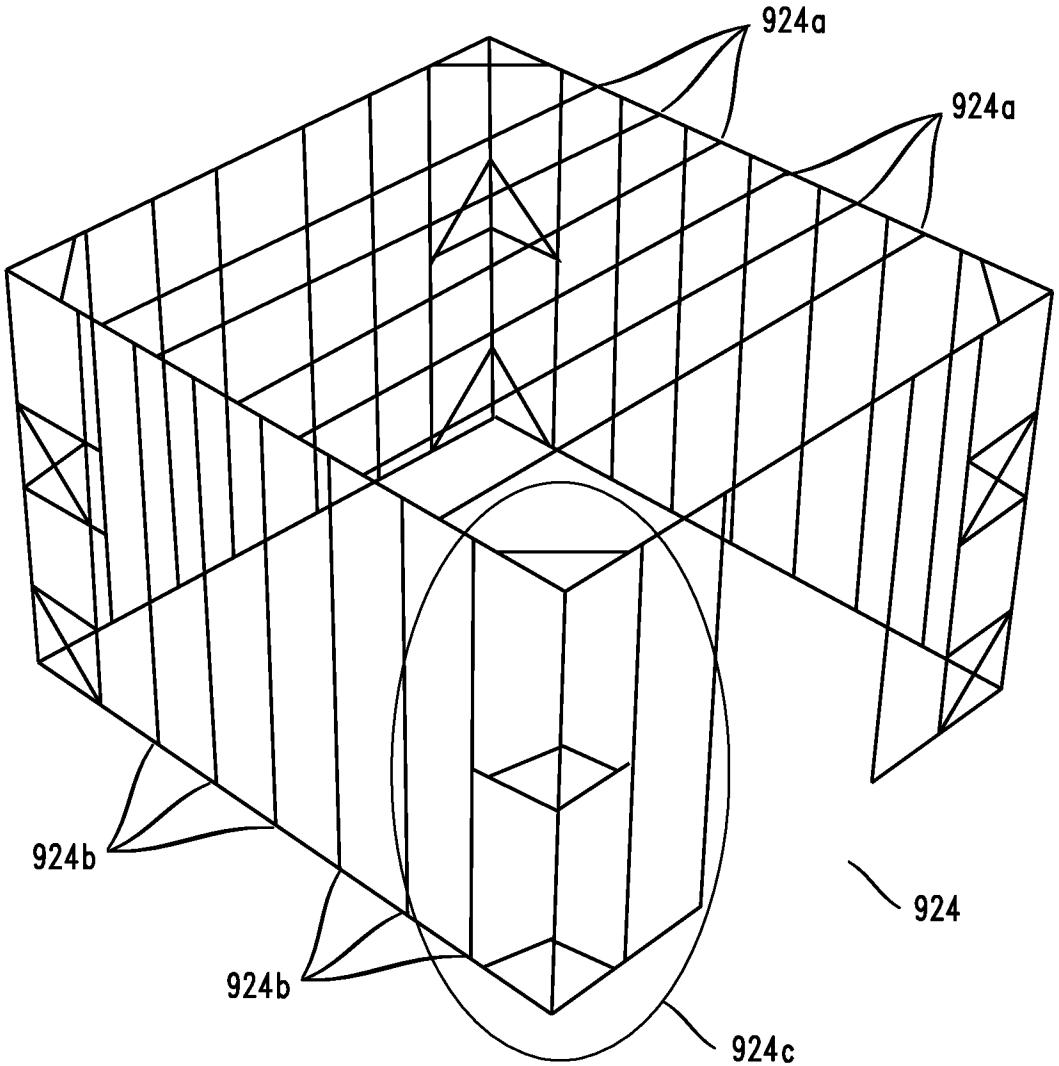
FIGS. 9D to 9F depict elements of inventive enclosures according to embodiments of the invention.
Figure 9E:
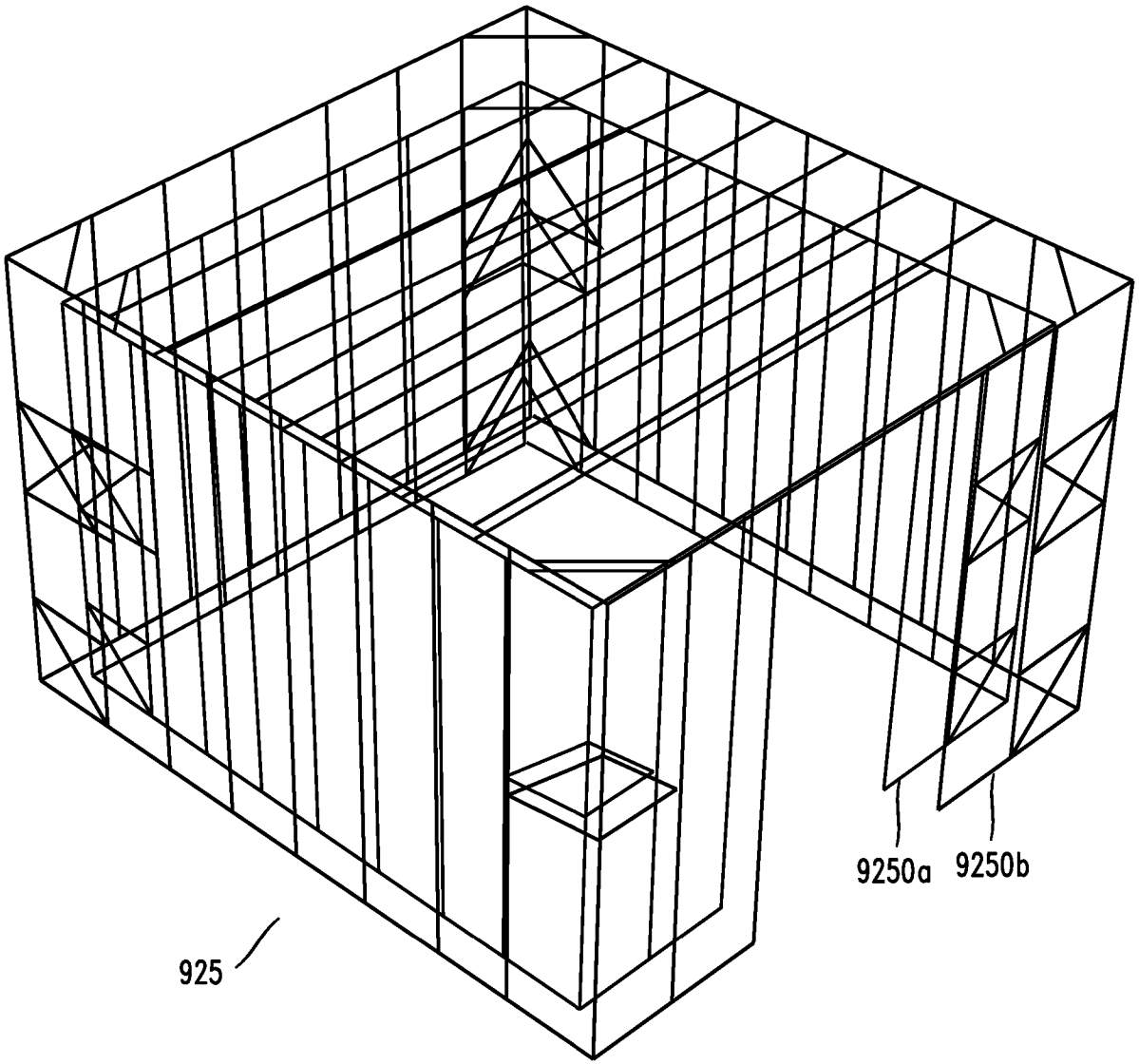
Figure 9F:
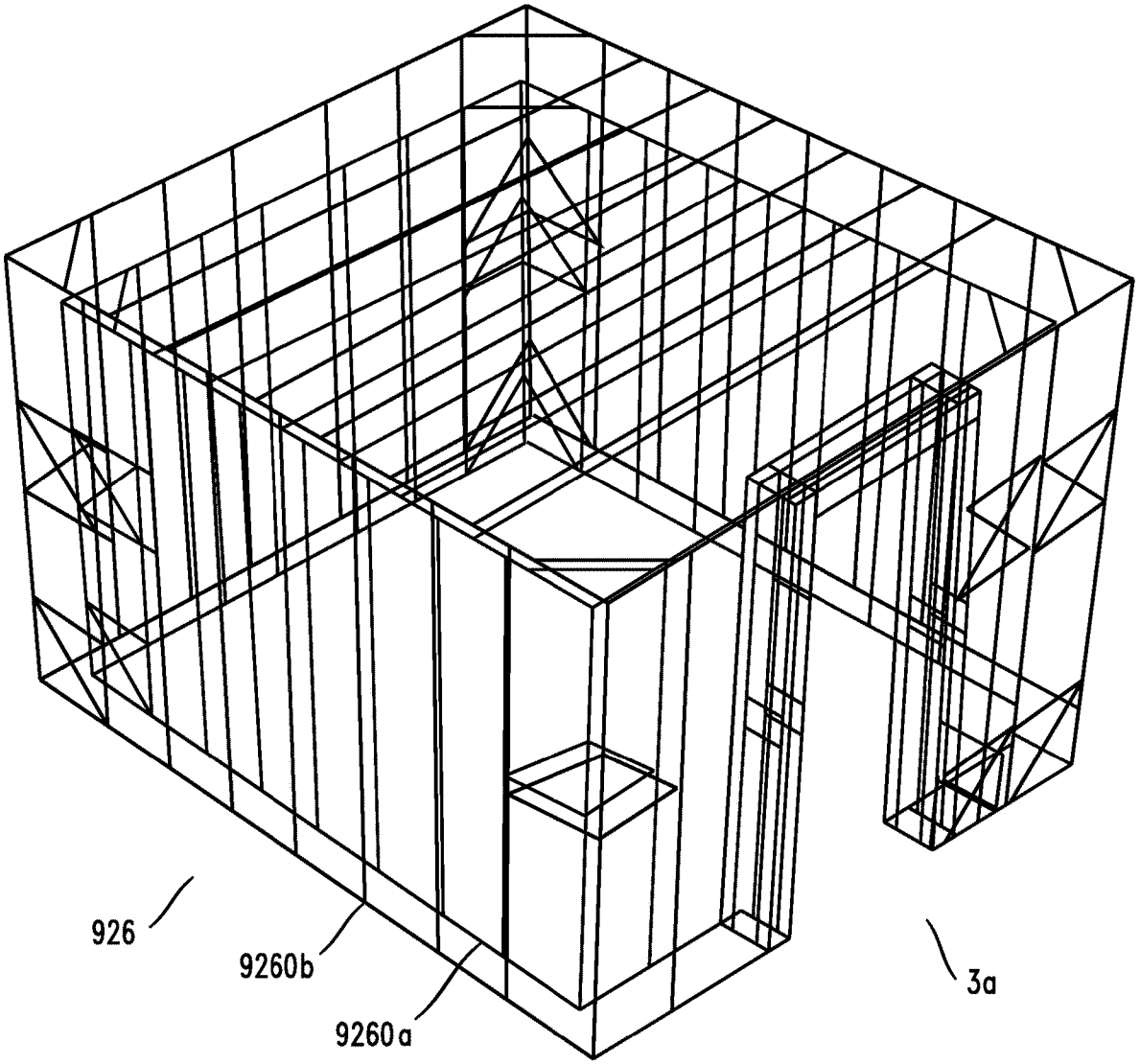

In another embodiment, inner enclosures provided by the present invention, such as enclosures 22*a*,322 may also include a multi-beam frame. An example of a multi-beam frame for inner enclosure 322 shown in FIG. 3A is frame 423 shown in FIG. 4. Further, FIGS. 9A through 9D depict additional embodiments of a multi-beam, inner enclosures 923,924. In FIG. 9A, the enclosures 923,924 may comprise a plurality of top non-conductive beams 923*a*, 924*a* respectively and a plurality of non-conductive side beams 923*b*, 924*ab*, respectively it being understood that both sides of the enclosure 923, 924 respectively includes side beams 923*b*, 924*b* (though only one side is labelled in FIG. 9A). In comparison to the multi-beam enclosures in FIGS. 3A and 4, the enclosures 923,924 comprise top and/or side beams 923*a,b* and 924*a,b* that comprise a one-part or one-piece beam while the beams in FIGS. 3A and 4 are multi-part beams that are connected, such as at connection points 331 in FIG. 3B. In embodiments of the invention, inner enclosures may be configured having all multi-part beams as side and top beams, all one-part beams as top and side beams, or a combination of multi-part and one-part beams as top and side beams. FIGS. 9B and 9C depict top and side views of the top beams 923*a* and side beams 923*b*, respectively, of the frame 923. Though six non-conductive beams are shown in FIGS. 9A through 9D it should be understood that an enclosure may include more or less than six top and/or side beams as a part of a top or side portion. For the reader's information, the frame 924 depicted in FIG. 9D includes a corner section 924*c* that has dimensions that are smaller than the corner section 923*c* depicted in the frame 923 of FIG. 9A (e.g., same height, but different volume). In an embodiment, the corner sections 923*c*,924*c* may be fully constructed and inserted into an inventive covering described herein in order to construct an inventive system.

It should be understood that in addition to the vestibule designs depicted in FIGS. 2I through 2K, each of the enclosures shown in the Figures herein may include alternative lightweight, opening and closure systems (e.g., glidable door as set forth in the '312 and/or '317 Application) or another means of accessing the inside of the enclosures, though such opening and closure systems may not be shown in each figure that depicts an enclosure. For example, referring to FIG. 9E there is depicted a system 925 according to an embodiment that includes both an inner frame 9250*a* of lightweight beams for an inner enclosure and an outer frame 9250*b* of lightweight beams for an outer enclosure. As shown on FIG. 9F a vestibule 3*a* may be added to a system 926 that comprises both inner 9260*a* and outer 9260*b* frames as well.

Some non-limiting dimensions and sizes for outer or inner exemplary enclosures are: 3×5×7, 6×6×7, 6×9×7, 9×9×7, or 9×12×7 to name just a few of the many sizes and dimensions that are possible in accordance with the teachings of the present invention.

As illustrated in FIGS. 2D, 2E, 3A, 3B, 4, 9A, 9D, 9E, 11D and 11E multi-beam frames provided by the present invention may comprise a number of individual non-conductive beams connected together. For example, the frame 423 in FIG. 4 may comprise a plurality of individual beams 424*a* to *n* (where "n" is the last beam). In FIG. 4, only three of the individual beams 424*a, b* and n have been labelled for the sake of clarity, however, it should be understood that each of the beams shown in FIG. 4 are similar to those that are labelled. In an embodiment, one or more of the exemplary beams 424*a*, 424*b*, and 424*n* (and other beams described herein) may comprise a lightweight, carbon-fiber material, for example, though other similar materials having the same or greater strength/rigidity and same or less weight may be used. Still further, it should be understood that each beam described herein may include one or more means for extending or retracting the length of such a beam (e.g., depressible button and slot configuration, adjustable pin). Once constructed, one or more shielded coverings comprising one or more layers of shielding material (e.g., see FIG. 8B) and one or more acoustical attenuation panels (see FIGS. 11A to 11E) may rest upon, and be supported by, a so-constructed, exemplary inventive frame.

Figure 5:
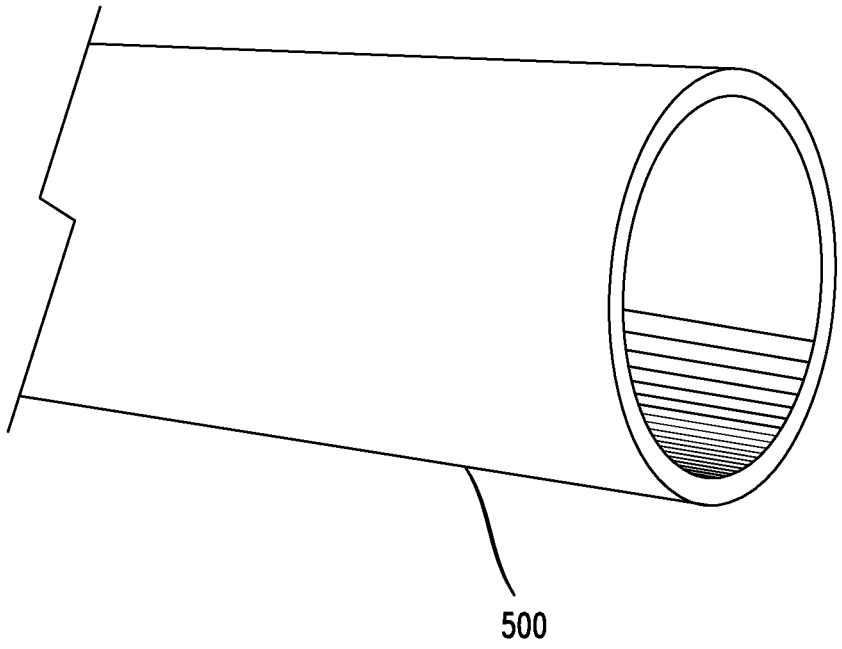
FIG. 5 depicts one end of an exemplary beam of a frame in accordance with an embodiment of the invention.

FIG. 5 depicts one end 500 of an exemplary beam in accordance with an embodiment of the invention. As shown, the beam may be hollow, though in other embodiments a beam may be substantially solid. It should be understood that the length, weight and cross-sectional dimensions (e.g., diameter) of a given beam (e.g., beams 424*a* to *n*) may vary depending on the size of a given frame, load bearing requirements and position within a frame among things.

In FIG. 5, the cross-sectional view of the end 500 of the non-conductive beam is shown as being circular. It should be understood, however, that the beams provided by the present invention may have various other cross-sectional shapes and dimensions, such as rectangular, triangular, hexagonal, etc., to name just a few examples. The cross-sectional dimensions of the beams provided by the present invention (and used as a part of each frame) may be varied to satisfy a given enclosure's shape, size, application, use and/or environment.

Figure 6A:
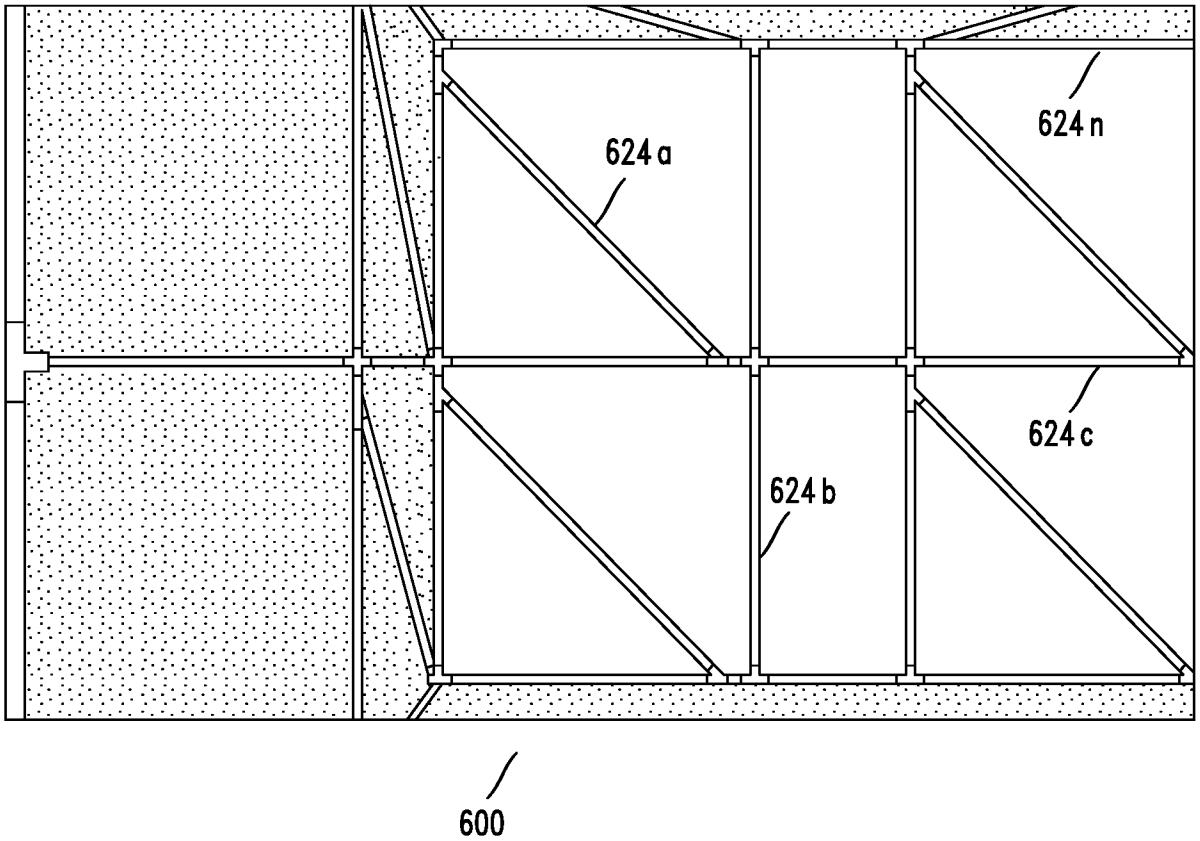
FIG. 6A depicts an exemplary multi-beam frame that comprises a plurality of non-conductive beams according to an embodiment of the invention.
Figures 6B, 6C:
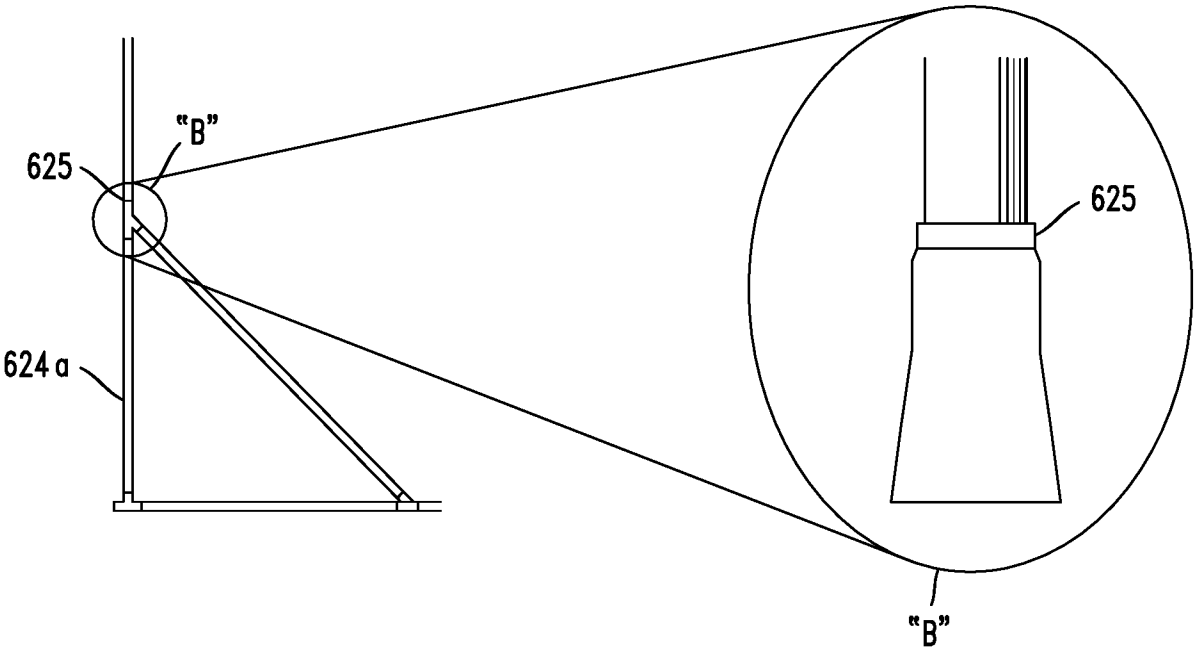
FIGS. 6B and 6C depict an exemplary segment of a multi-beam frame according to an embodiment of the invention.

FIG. 6A depicts an exemplary multi-beam frame 600 that comprises a plurality of beam segments 624*a* to *n*. Though only a few of the individual beam segments 624*a* to n have been labelled in FIG. 6 for the sake of clarity, it should be understood that each of the beam segments shown in FIG. 6 are similar to those that are labelled. In embodiments of the invention, the frame 600 (and the other frames described herein) may be configured so that the beam segments provide a very strong structure, and multiple points of support for a removable panel, covering or other shielded layer. FIG. 6B depicts an exemplary segment 624*a* of a multi-beam frame that includes an indicator 625 according to an embodiment of the invention. In one embodiment, the indicator 625 functions to identify the particular segment 624*a* and its function and position within the frame 600 for ease of installation. For example, the indicator may comprise a colored indicator 625 that identifies the segment 624*a* as corresponding to a segment that is to be positioned at a certain location within the frame 600 to fulfill a certain function (i.e., side support, top support). In embodiments, segments that perform the same function may be color-coded with the same code, for example, and, conversely, segments that perform different functions may be color-coded with different colors, for example. In addition to colors, the indicator may include a marking, such as a numeric, alpha-numeric or alphabetic code where a particular code may correspond to a beam segment that is to be positioned at a certain location within the frame 600 to fulfill a certain function (i.e., side support, top support). In embodiments, beam segments that perform the same function may include the same code, for example, and, conversely, segments that perform different functions may include a different code, for example.

Figure 7A:
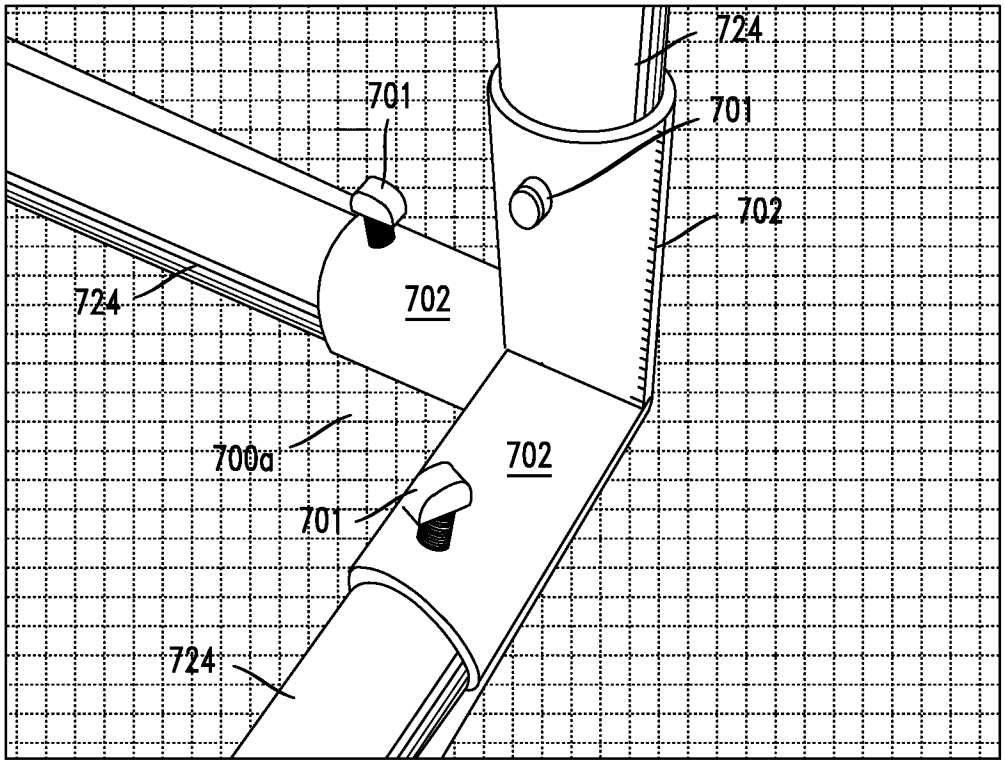
FIGS. 7A to 7E depict exemplary connectors and connections according to embodiments of the invention.

FIGS. 7A to 7D depict exemplary connectors 700*a* to 700*d* that are operable to (i.e., function to) connect one or more non-conductive beams 724 (and other beams described herein). In FIG. 7A a corner connector 700*a* is depicted connecting three beams 724. In an embodiment, the connector 700*a* comprises channel sections 702. Into each channel section 702, a beam is inserted and then fixed to the channel section 702 using an adjustable pin 701. In one embodiment, each of the connectors 700*a* to 700*d* may comprise a carbon or nylon material.

Figure 7B:
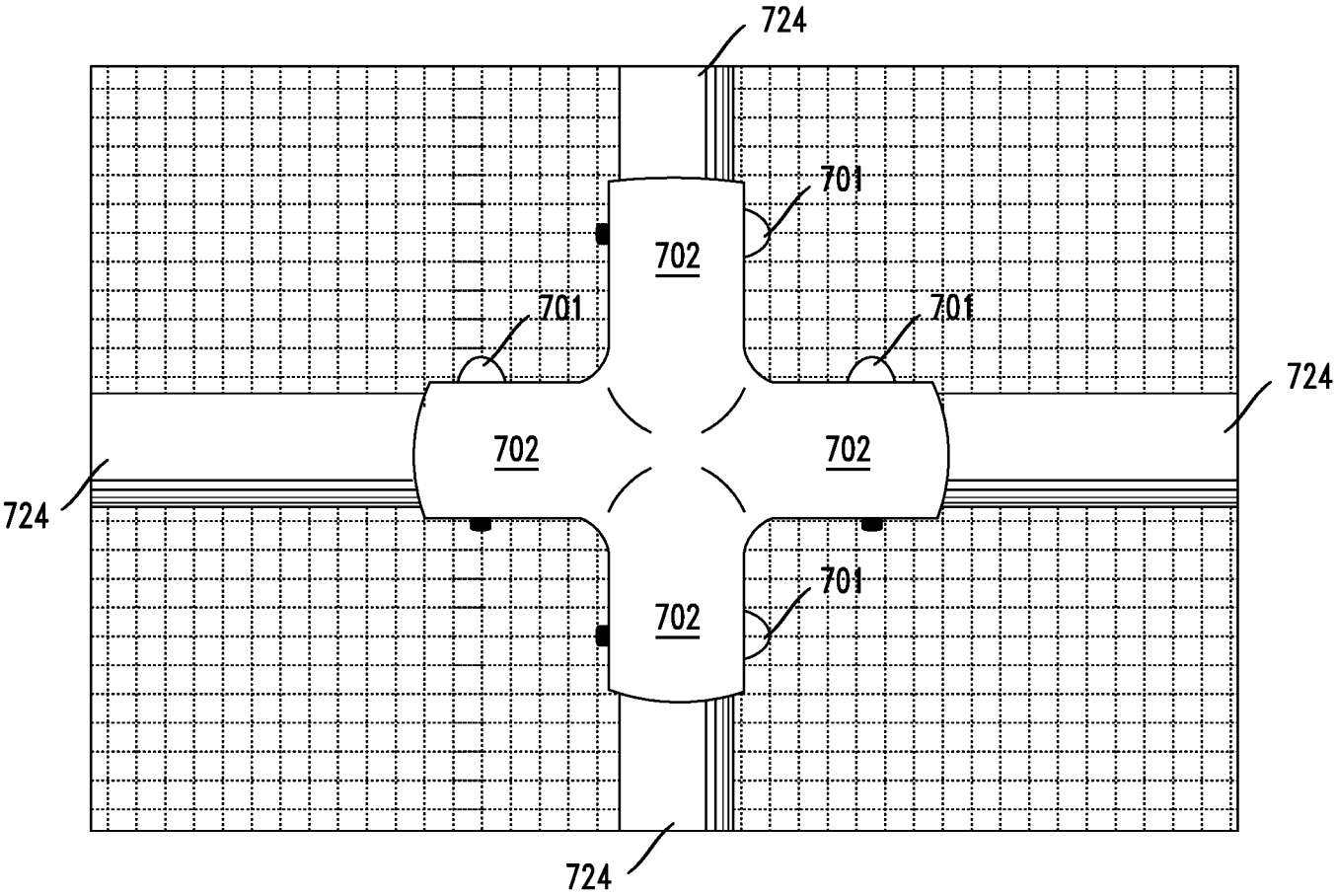
Figure 7C:
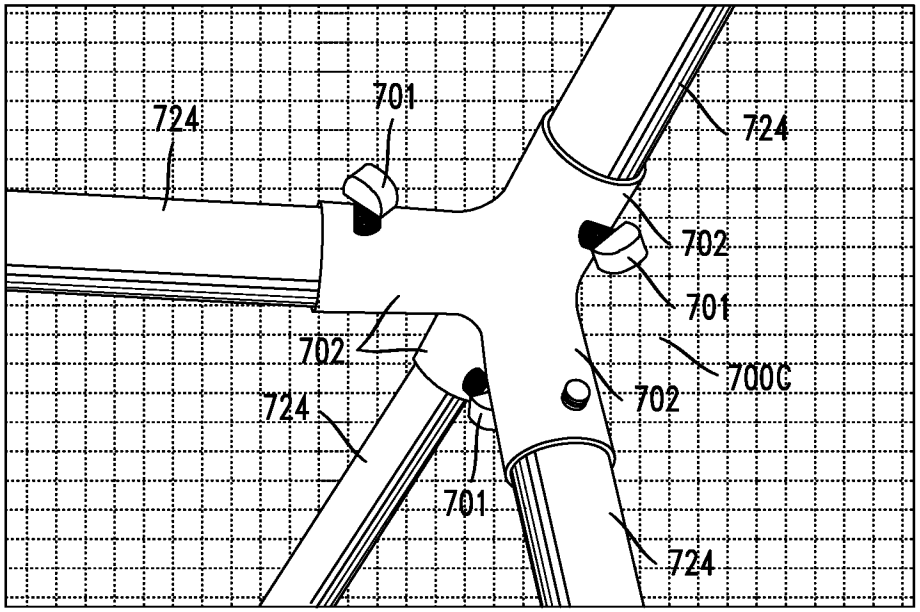
Figure 7D:
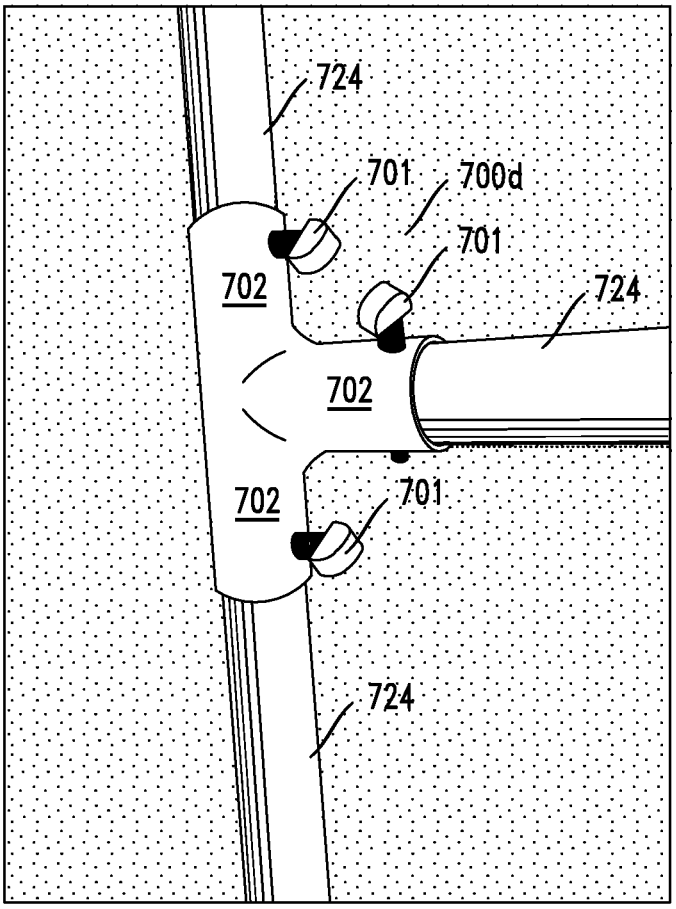
Figure 7E:
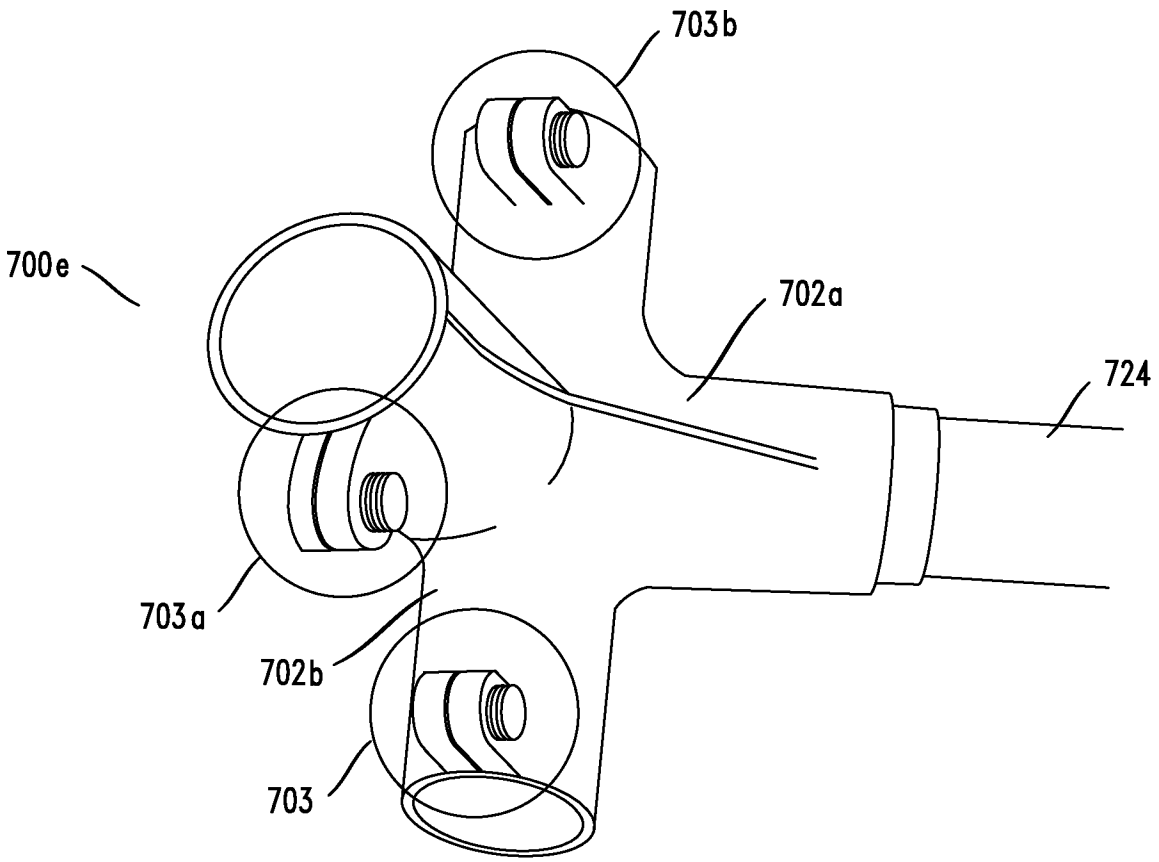

Similarly, in FIG. 7B a cross-connector 700*b* is depicted connecting four beams 724. In an embodiment, the connector 700*b* comprises channel sections 702 all in one plane. Into each channel section 702, a beam is inserted and then fixed to the channel section 702 using a pin 701. In FIG. 7C a different cross-connector 700*c* is depicted connecting four beams 724. In an embodiment, the connector 700*c* comprises channel sections 702 in different planes. Into each channel section 702, a beam is inserted and then fixed to the channel section 702 using a pin 701. In FIG. 7D a T-shaped connector 700*d* is depicted connecting three beams 724. In an embodiment, the connector 700*d* comprises channel sections 702. Into each channel section 702, a beam is inserted and then fixed to the channel section 702 using a pin 701. In an alternative embodiment, rather than use adjustable pins to affix a connector to a beam, adjustable screws may be used. For example, FIG. 7E depicts a connector 700*e* that is operable to receive beam 724. In an embodiment, the connector 700*e* comprises a channel section 702*a*. The beam 724 and/or channel section 70*a*2 may have a layer of glue provided on its surface that functions to form a connection between the beam 724 and channel section 702*a* when the beam is inserted into the channel section 702*a*. The beam may also be secured to the channel section 702*a* using an adjustable screw (not shown in figure) such as screw 703*a* positioned similar to pins 701 depicted in FIGS. 7A,7B. Additional adjustable screws 703*b,c* may be used to secure one channel or beam section 702*a* to another section or element of the frame 702*b*. It should be understood that adjustable screws may be used in place of adjustable pins, including those depicted in FIGS. 7A through 7D.

Figure 8A:
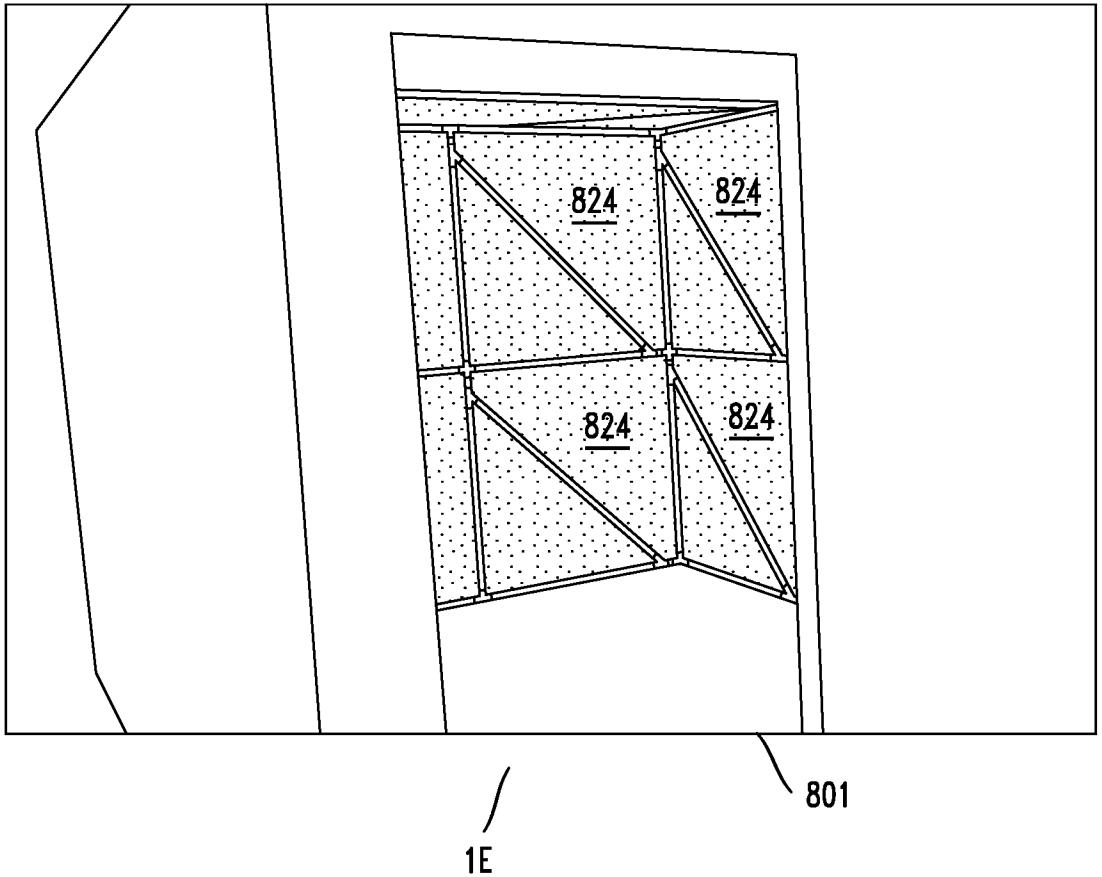
Figure 8B:
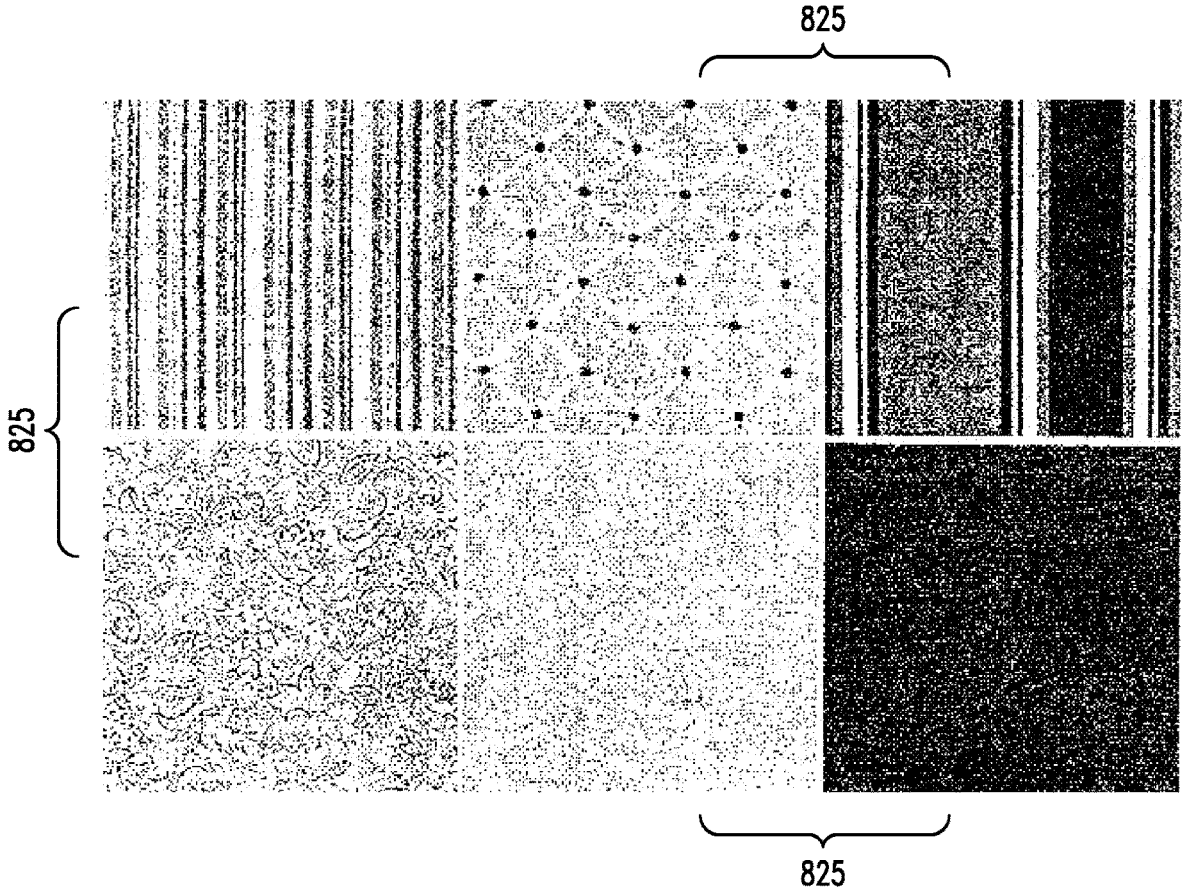
FIG. 8B depicts removable panels configured in a plurality of shapes, sizes and colors.
Figure 11A:
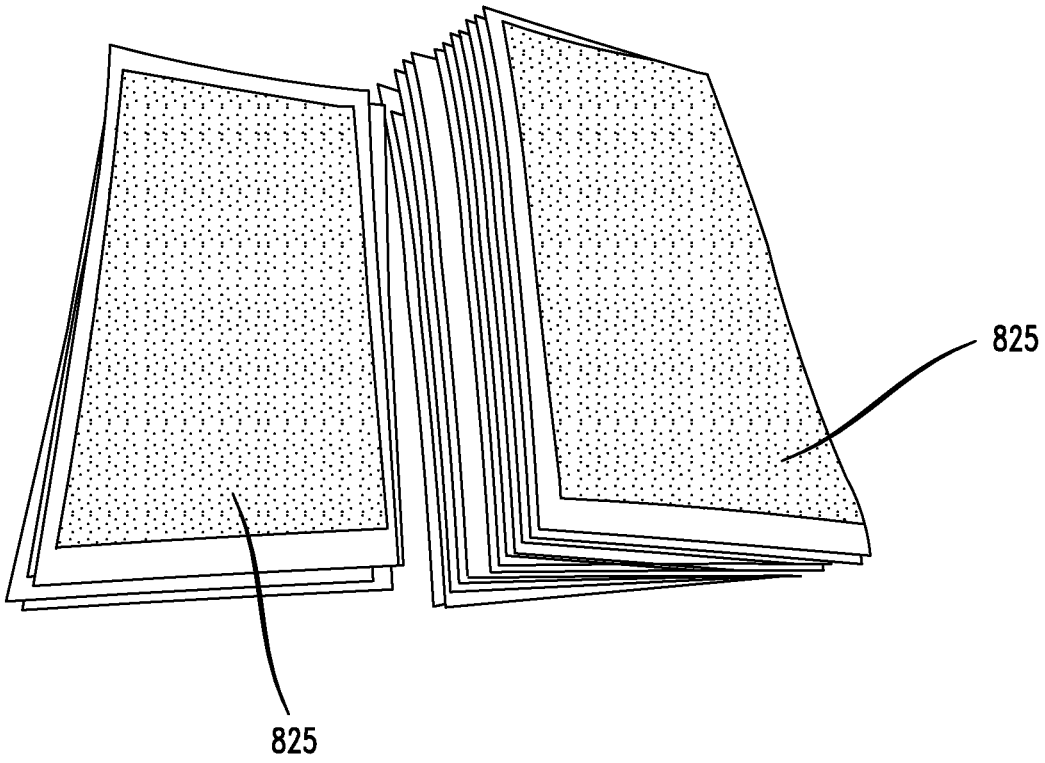
FIGS. 11A to 11E depict removable, acoustic protective panels according to embodiments of the invention.
Figure 11B:
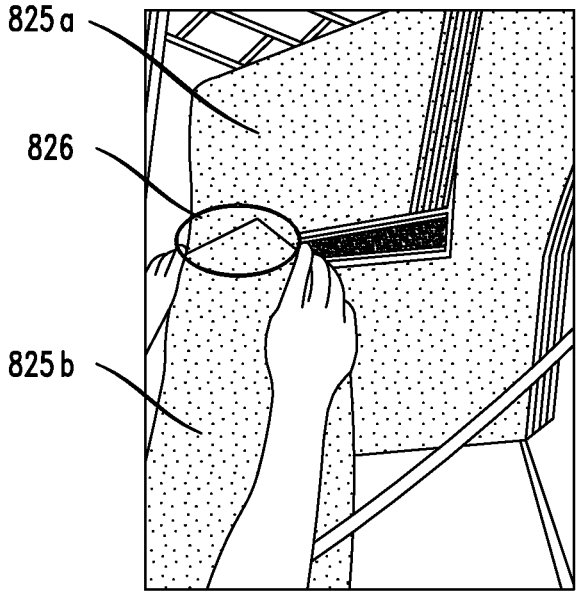
Figure 11C:
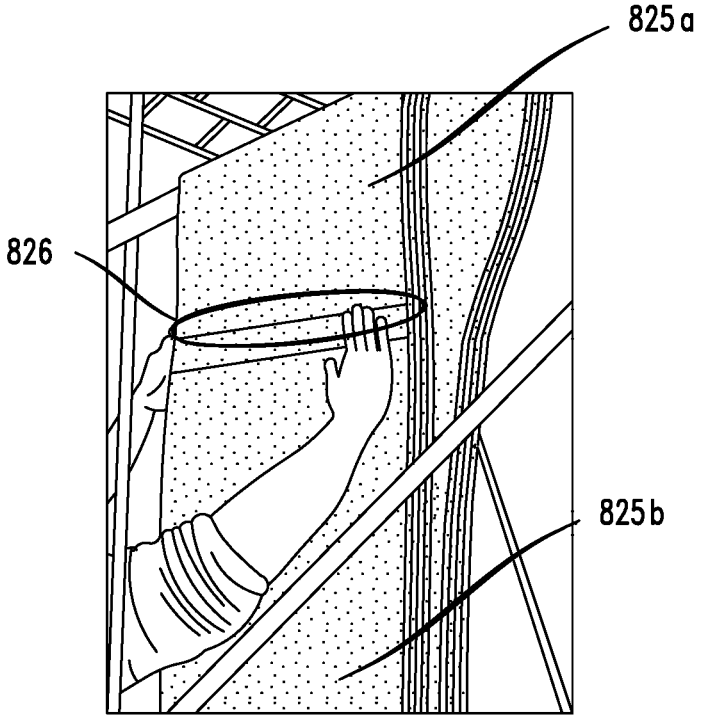
Figure 11D:
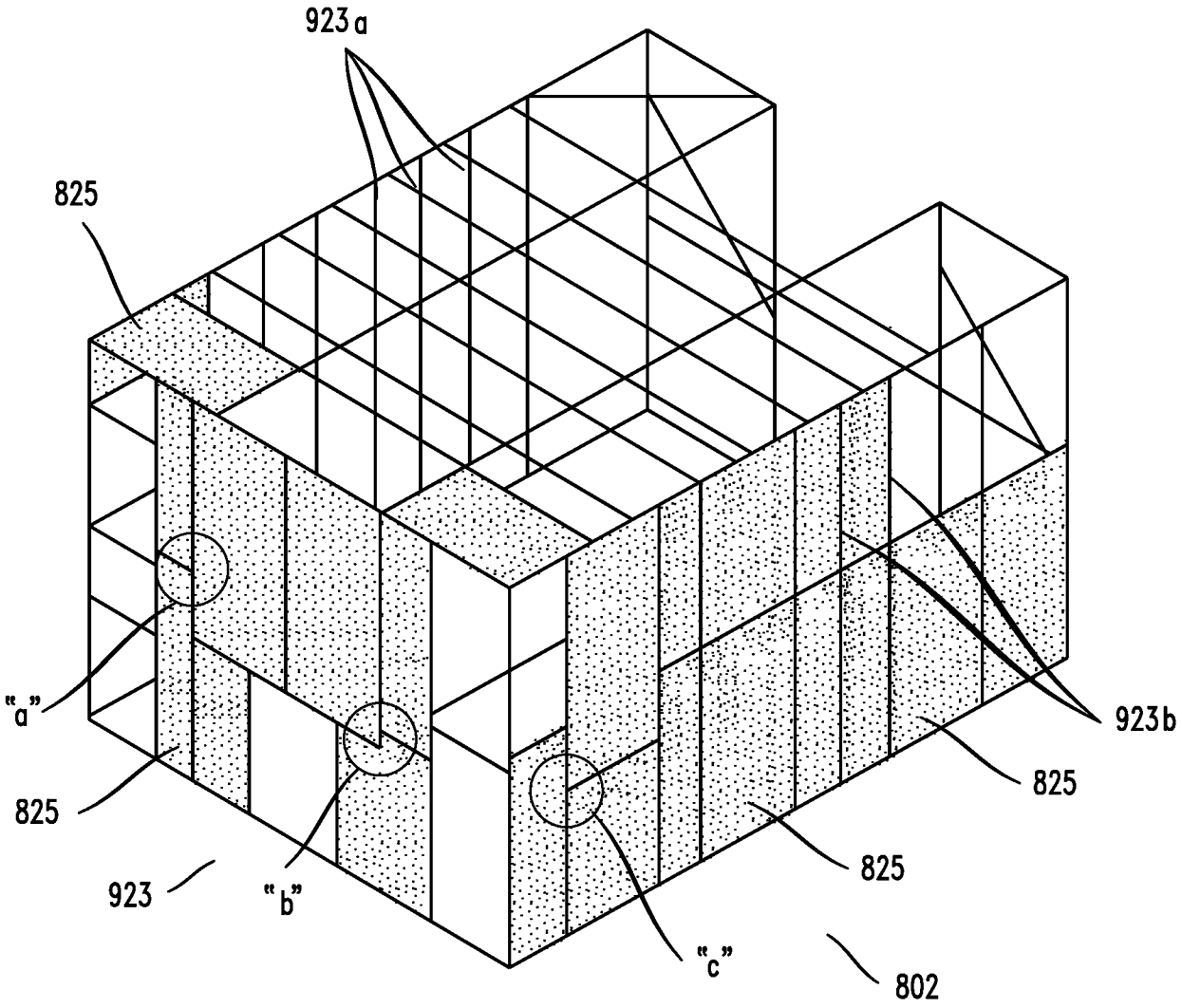
Figure 11E:
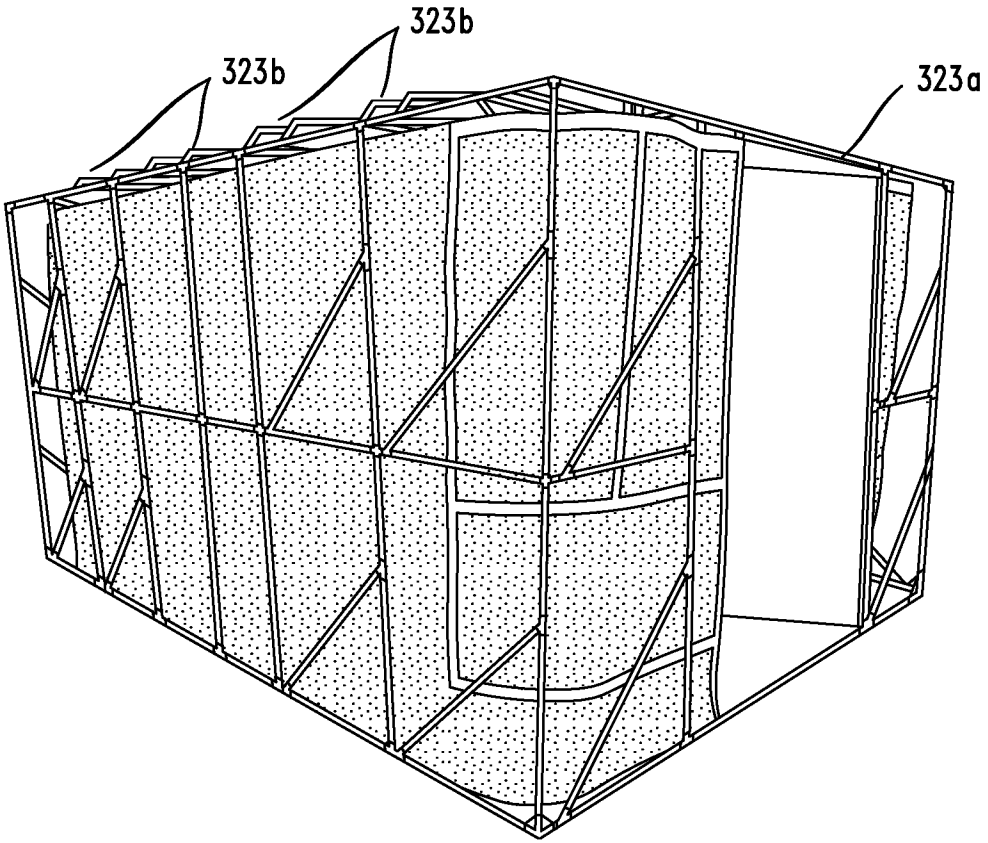

In FIG. 8A there is depicted a system 1E that comprises a plurality of acoustic, EMI/RF, EMP and infrared protective layers 824 of enclosure 801. In an embodiment one or more layers 824 may comprise one or more removable panels 825, each having an inner and outer surface. The panels 825 may be configured in a plurality of shapes, sizes and colors, including those shown in FIG. 8B. Referring now to FIG. 11A there is depicted a close-up view of a removable, passive sound attenuation panel 825, The panel 825 may comprise one or more layers of acoustical absorbing or reflective material that function to attenuate sound from escaping the inside of an enclosure, such as enclosure 801 (or vice-versa). FIGS. 11B and 11C depict means for connecting 826 acoustic panels 825*a*, 825*b*. As depicted each panel 825*a,b* may comprise Velcro strips 826 as one means of overlappingly connecting a side of panel 825*a* to a side of another panel 825*b*. In embodiments, an inner enclosure, such as enclosure 802 depicted in FIG. 11D, may include a plurality of such acoustic panels 825 arranged in an overlapping manner on, and/or connected to, top and side non-conductive beams 923*a,b* beams of a frame 923 so that the beams support the panels. As additionally depicted in FIG. 11D, one or more of the panels 825 may be overlapped, such as at points "a", "b" and "c". Once an inner frame is covered or otherwise encased in acoustic panels, an outer frame with, such as frame 323 in FIG. 3A,925*b* in FIG. 9E and 323*a* 11E, may be configured substantially around the encased inner frame. In the embodiment depicted in FIG. 11E the outer frame 323*a* may comprise top beams 323*b* that comprise a truss configuration, for example.

Figure 10A:
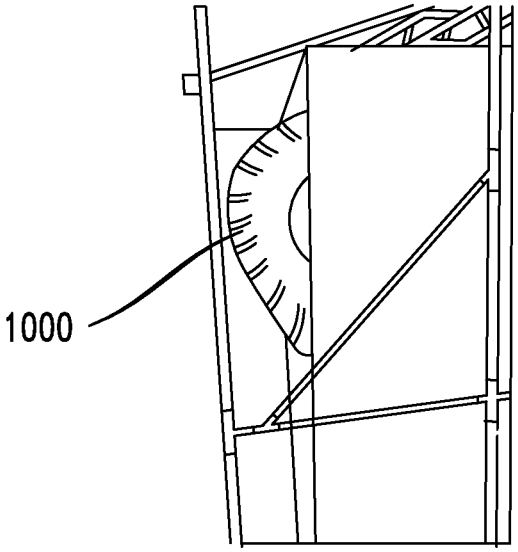
FIGS. 10A through 10C depict air circulation trunks according to embodiments of the invention.
Figure 10B:
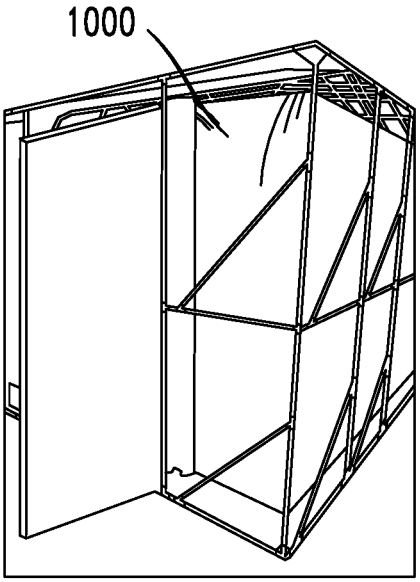
Figure 10C:
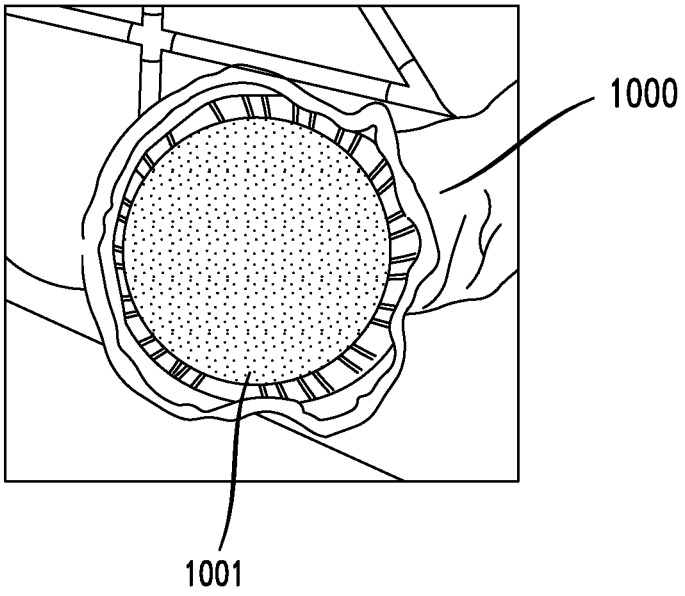

Referring now to FIGS. 10A and 10B, there is depicted an air circulation trunk or passageway 1000 ("trunk"). In an embodiment, systems provided by the present invention may comprise one or more such trunks. For example, an exemplary system may include four such trunks, where each trunk may be configured or positioned at an upper corner of an enclosure, for example. Further, an exemplary trunk may comprise an inner rigid tubing (not shown in figures) that functions to ensure that air can flow through a trunk without being obstructed. Referring now to FIG. 10C, a trunk may include a wave guard vent 1001 inserted into an inner passageway of the trunk that functions to attenuate unwanted signals, such as radio frequency or milli-meter wave frequencies for example, from penetrating or escaping an enclosure through the inner passageway, for example. In alternative embodiments additional vents or filters may be added to in the inner passageway to filter air, gases or additional frequencies (e.g., audio).

Figure 12A:
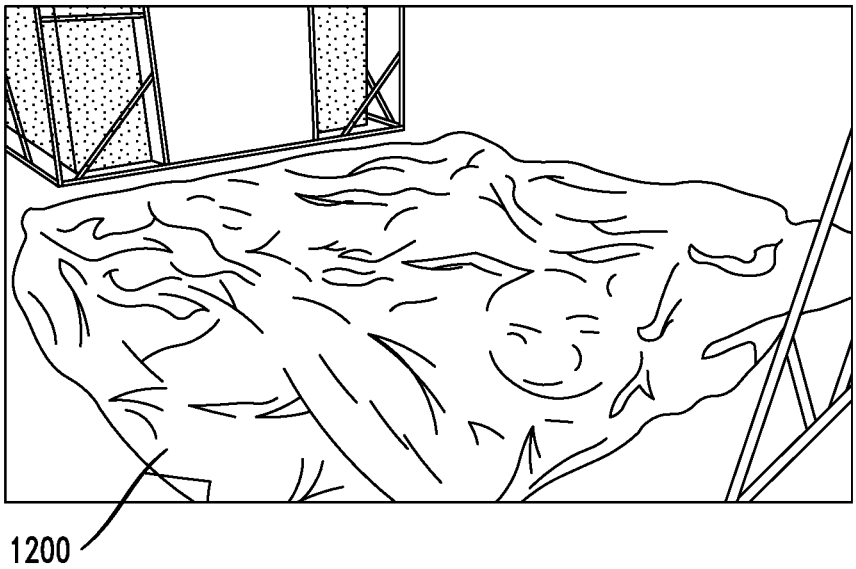
FIGS. 12A through 12Q depict a method for erecting an enclosure according to an embodiment of the invention.
Figure 12B:
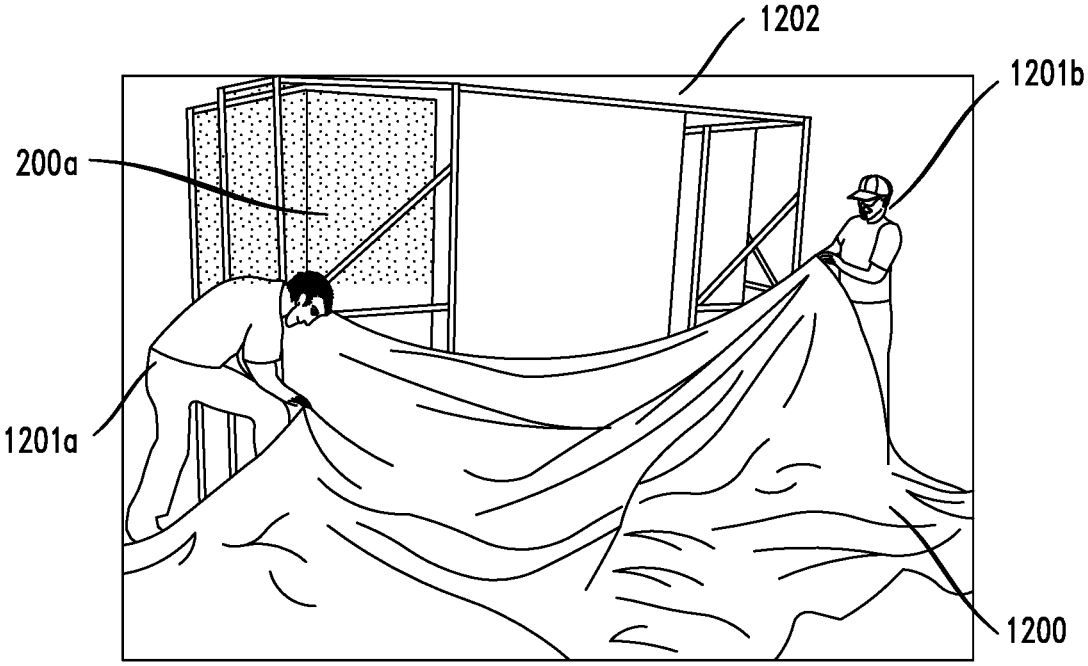
Figure 12C:
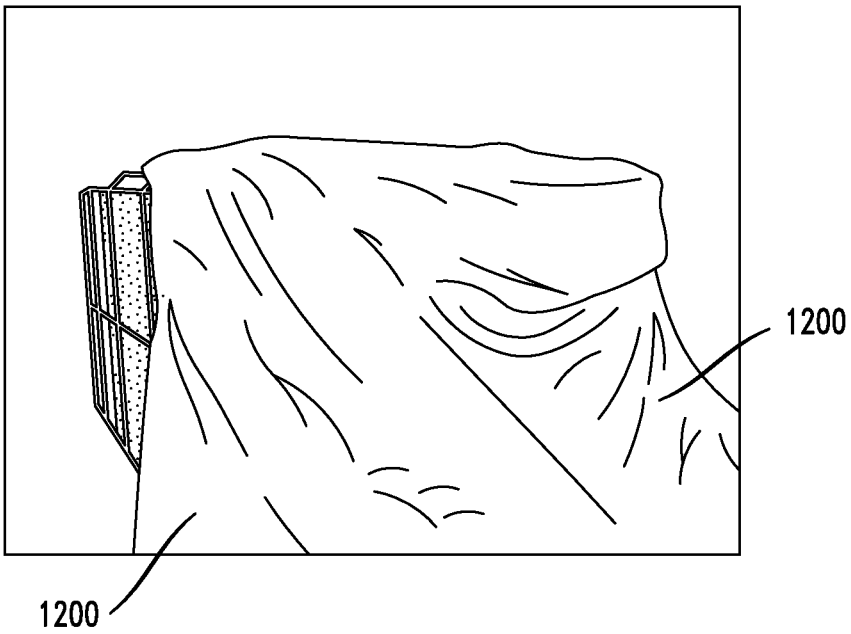
Figure 12D:
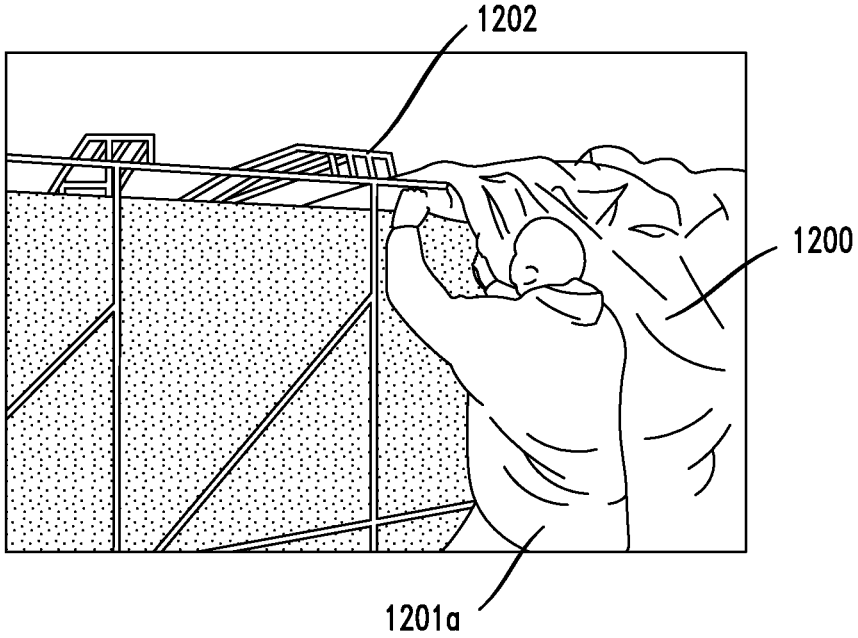
Figure 12E:
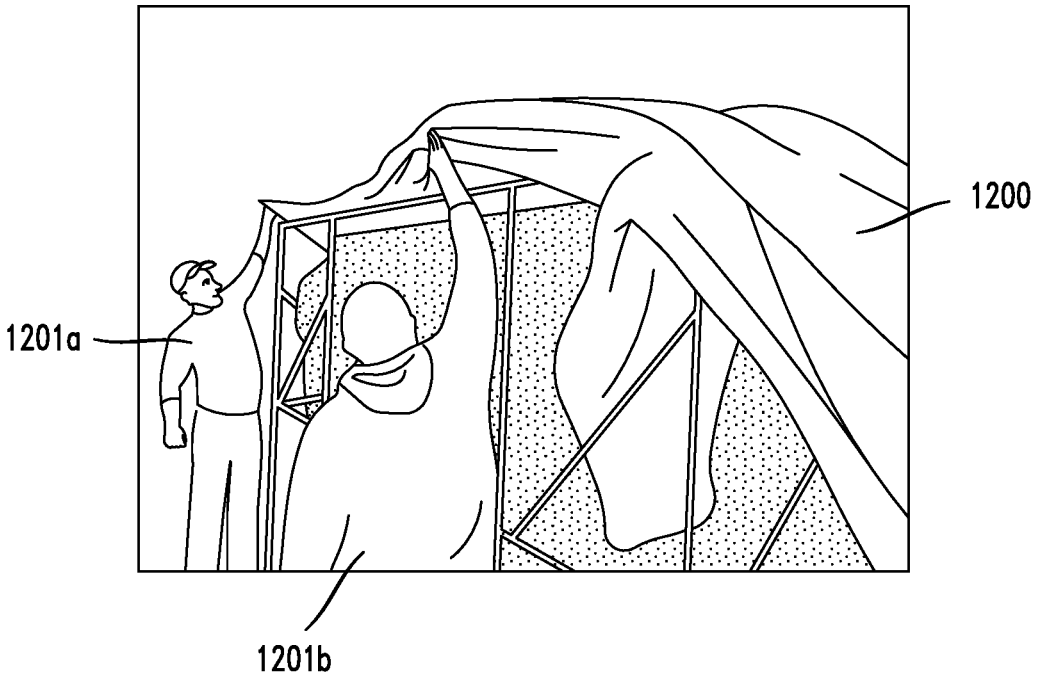
Figure 12F:
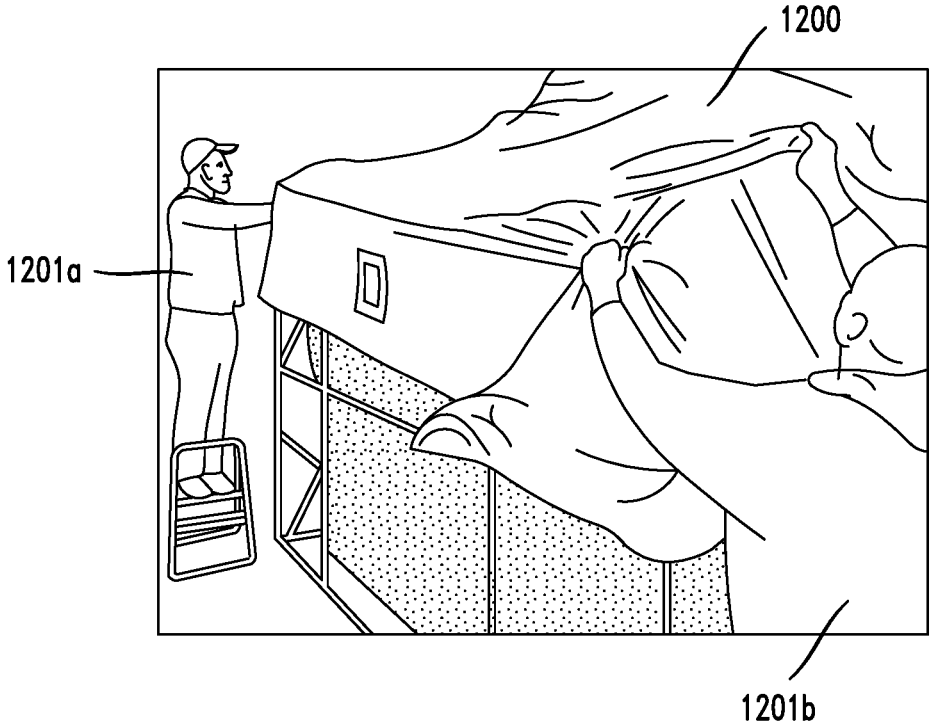
Figure 12G:
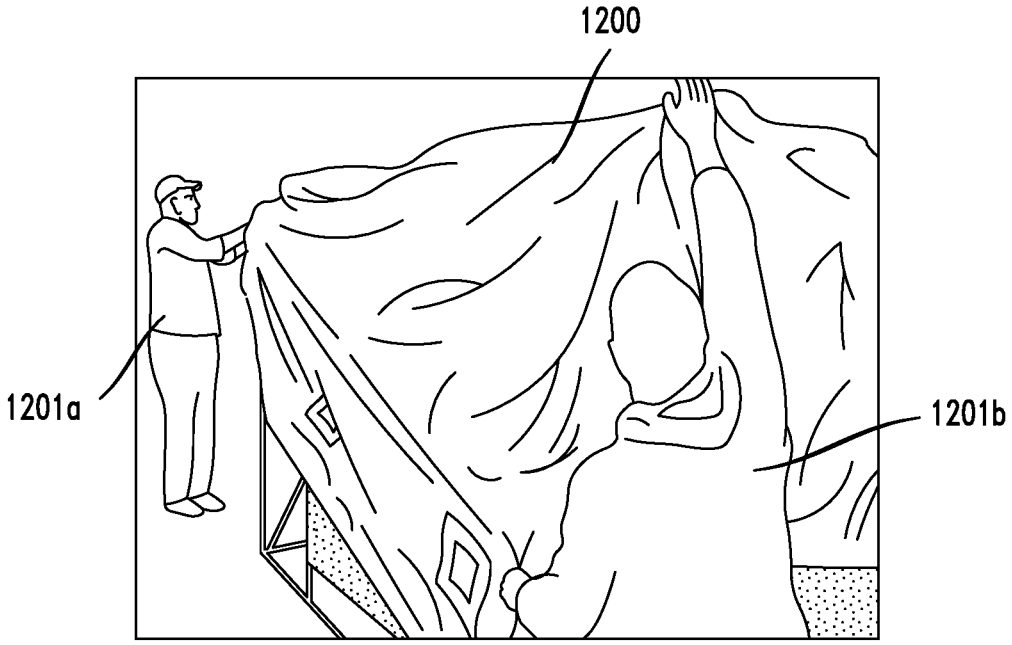
Figure 12H:
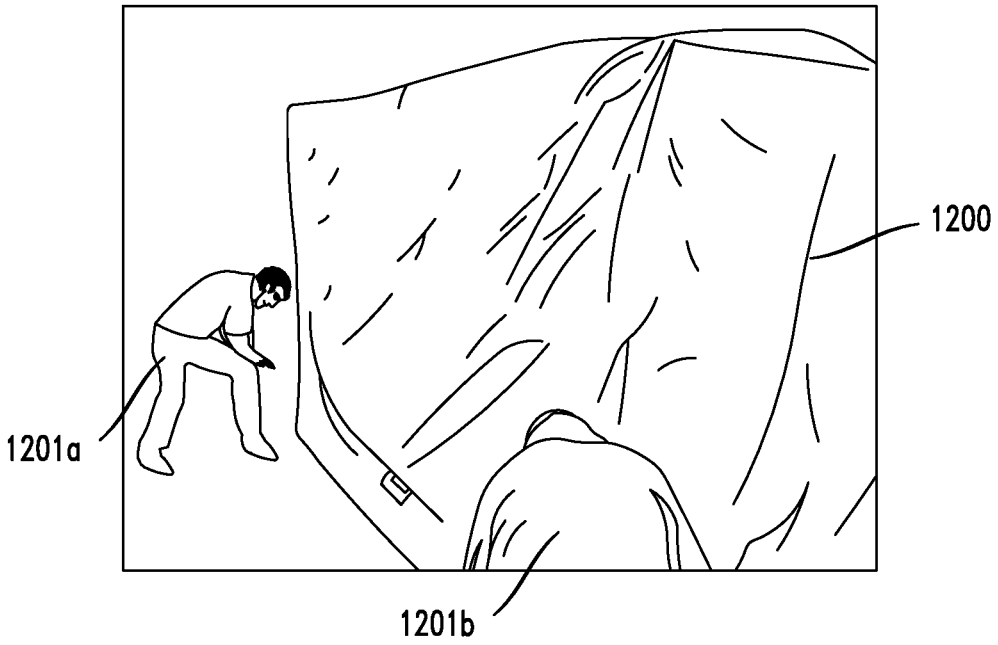
Figure 12I:
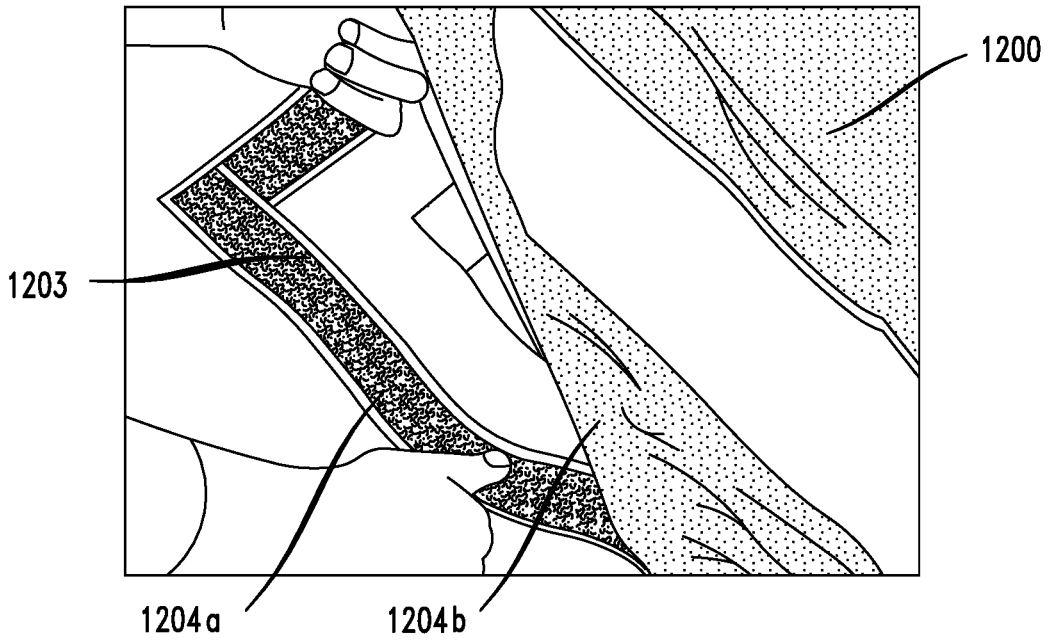
Figure 12J:
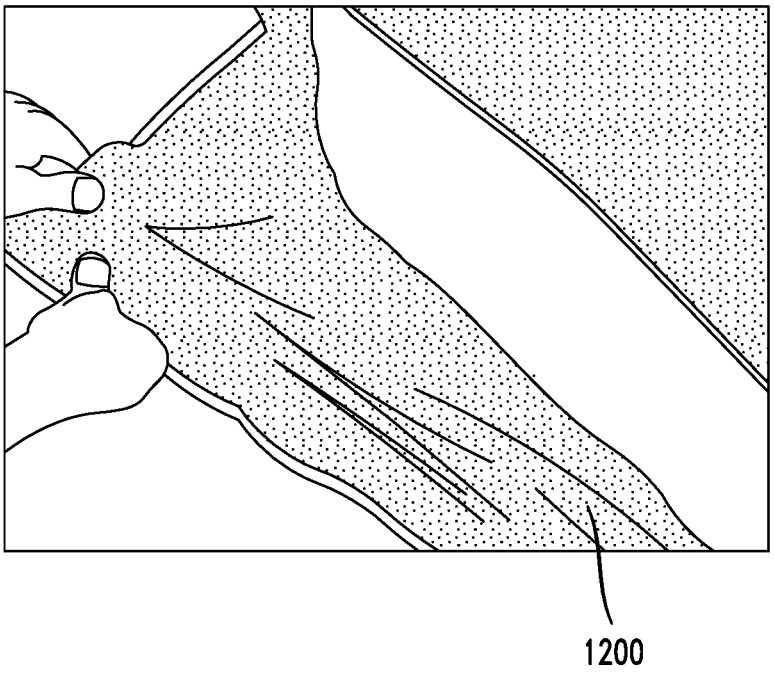
Figure 12K:
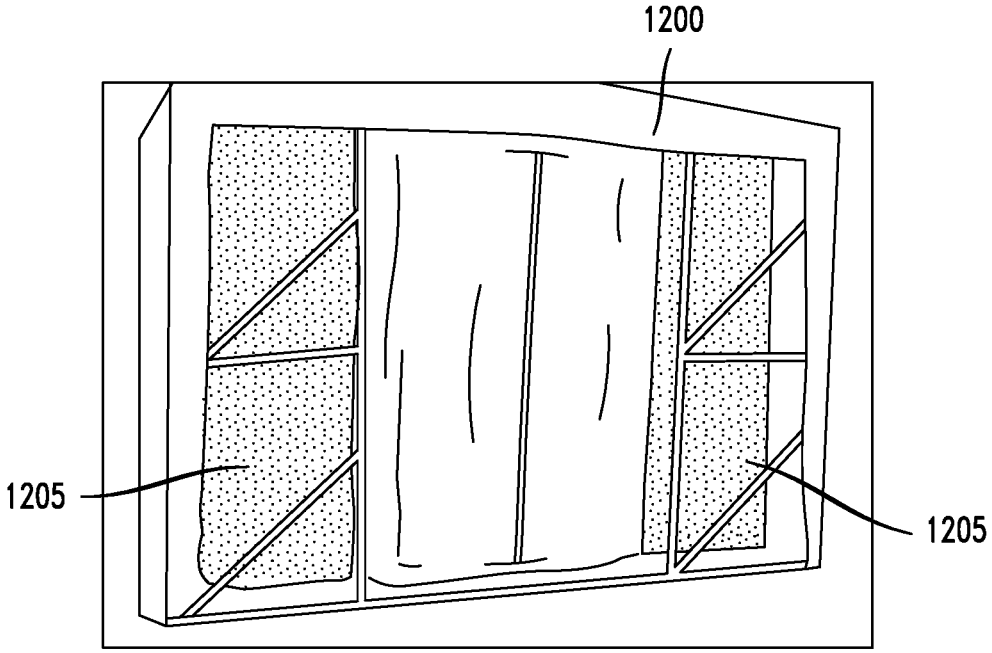
Figure 12L:
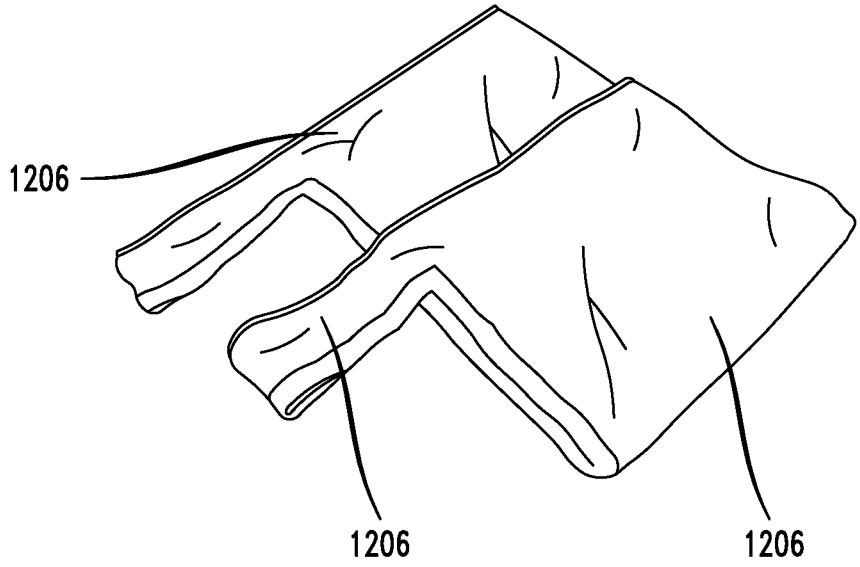
Figure 12M:
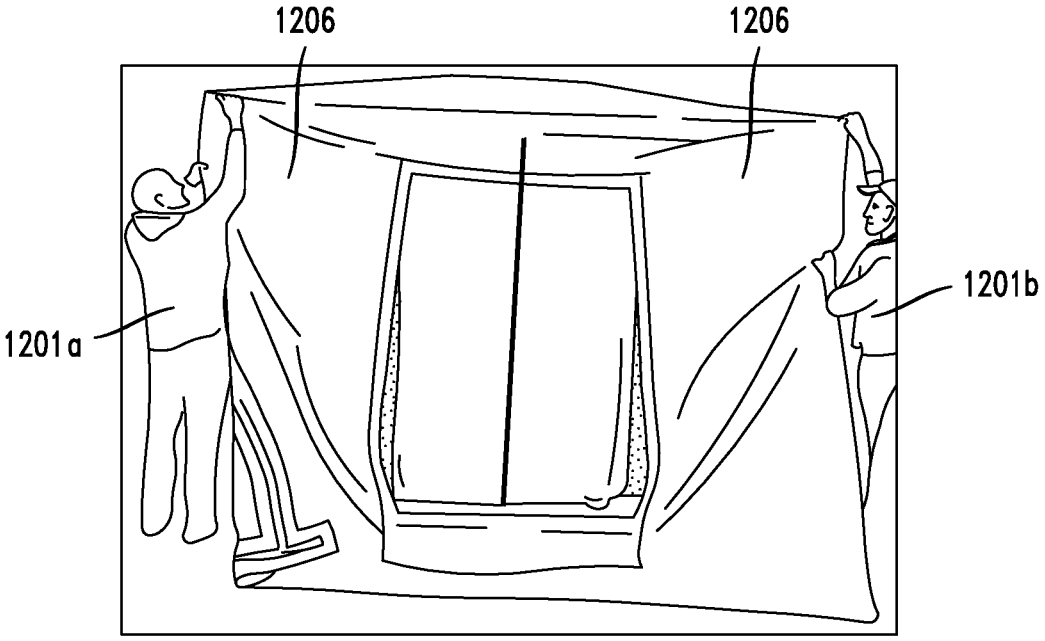
Figure 12N:
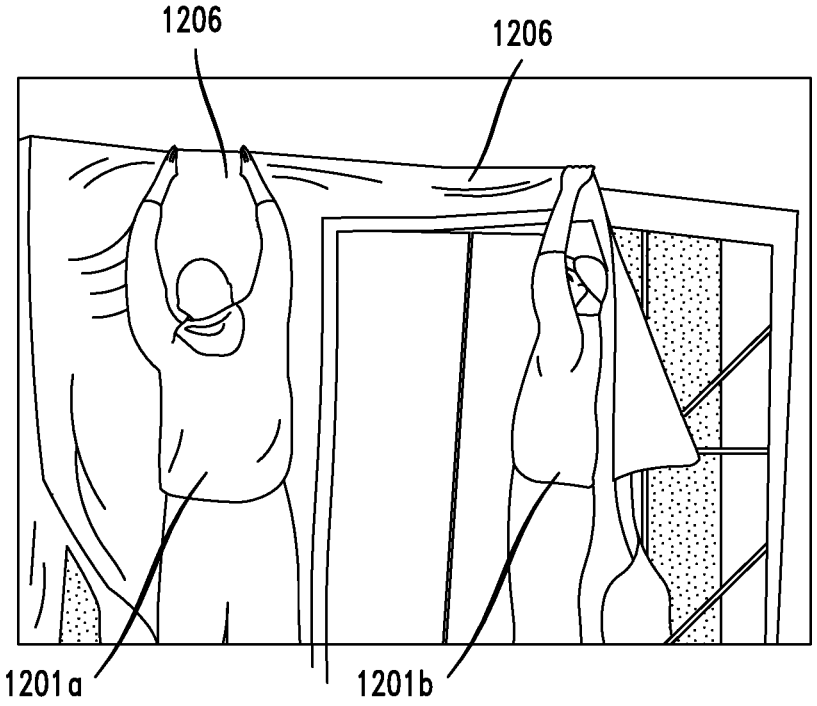
Figure 120:
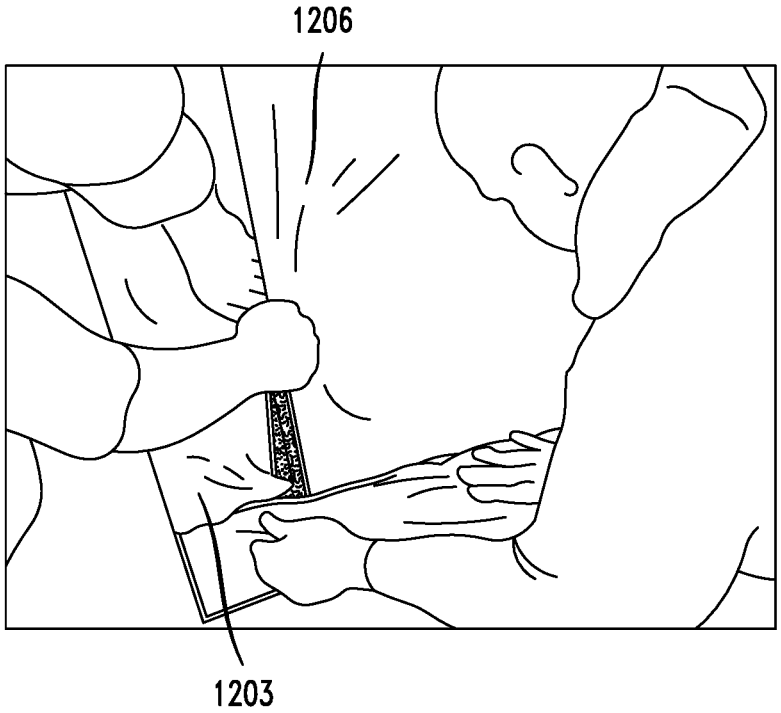
Figure 12P:
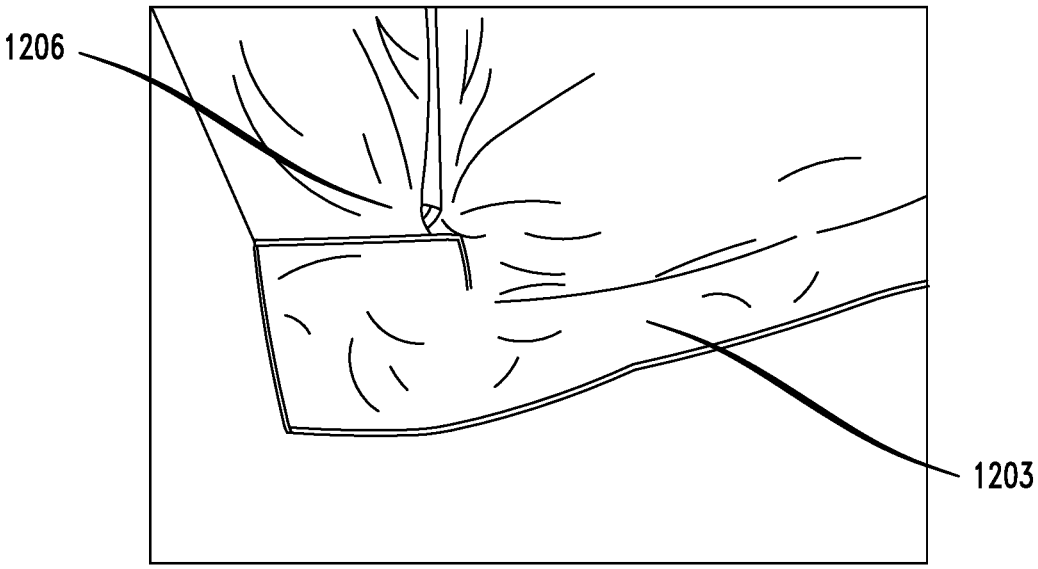
Figure 12Q:
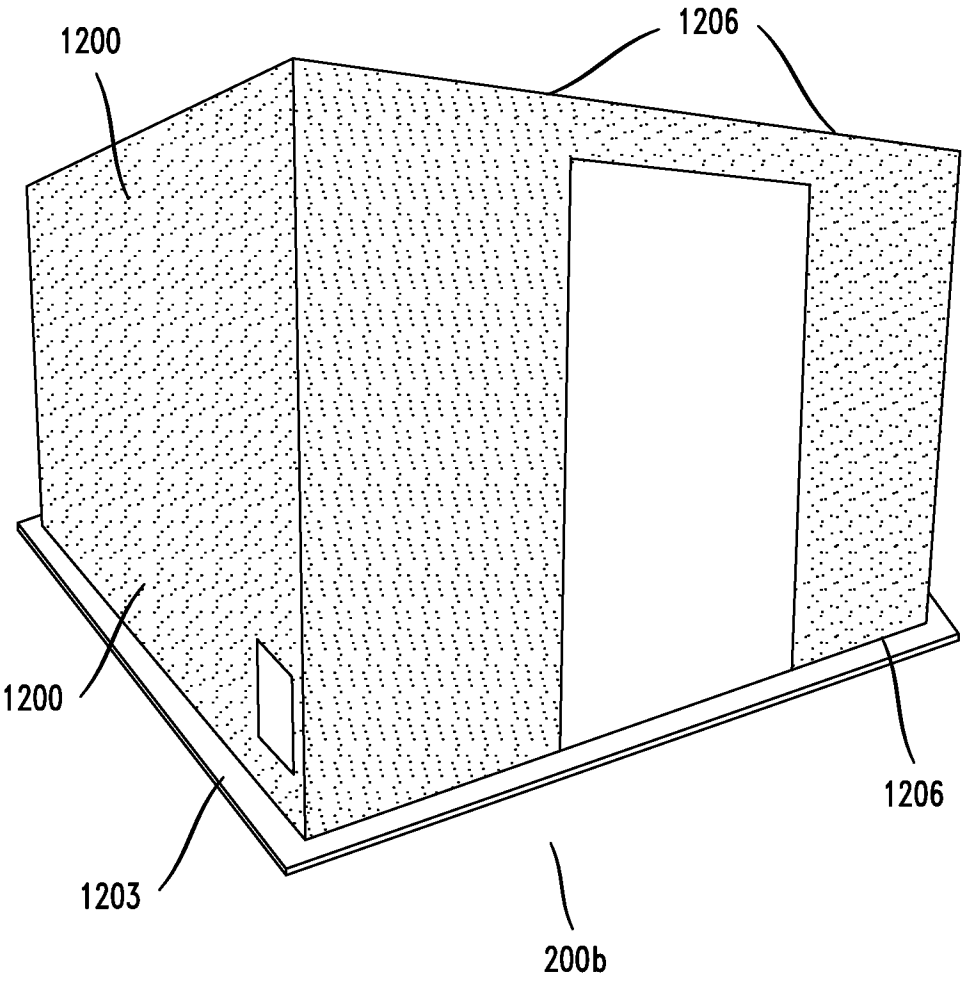

FIGS. 12A through 12Q depict a method for erecting an outer enclosure surrounding an already constructed inner enclosure 200*a* according to an embodiment of the invention. In FIG. 12A, an outer shielded covering 1200 is shown laid out, where each corner of the covering 1200 may include an identifier or mark (not shown in Figure) for easy installation. In FIG. 12B, two individual installers 1201*a,b* may each grab the back lower and back upper corners of the covering 1200. Thereafter, in FIGS. 12C and 12D the installers 1201*a,b* (only one shown in FIG. 12D) may pull the covering 1200 over the back of the enclosure (the side opposite the front or opening). In FIGS. 12E through H, the installers 1201*a,b* may continue to pull the covering 1200 across the top of the enclosure and then down to the bottom of the enclosure where the installers 1201*a,b* can connect to the floor 1203 of the enclosure. In FIGS. 12I and 12J, in an embodiment, ends of the covering 1200 and ends of the floor 1203 may include connection means 1204*a,b* respectively, such as conductive, mating conductive Velcro strips, that function to form a connection when the strip 1204*a* of the floor 1203 is brought into contact with the strip 1204*b* of the covering 1200. The connection formed functions to create a secure radio-frequency barrier. To complete the installation, the installers insure that every section of the ends of the floor and ends of the covering form connections as explained above.

Referring to FIGS. 12K and 12L, in an embodiment, after the covering 1200 is placed over the top and sides of an outer frame a front covering 1206 may be placed over a front section 1205 of the frame. Thus, this enclosure utilizes a two-piece covering 1200, 1206. In FIG. 12M, installers 1201*a, b* may raise the front covering 1206 and attached or otherwise connect the front covering 1206 to the covering 1200 by connection means. Similar to above, ends of each of the covering 1200 and front covering 1206 may include connection means (nots shown in figures) respectively, such as conductive mating Velcro strips, that function to form a connection when the strip of the covering 1200 is brought into contact with the strip of the front covering 1206. In an embodiment, installers 1201*a,b* may form connections at the top corners of the frame. Referring to FIGS. 12O and 12P, once the covering 1200 and front covering 1206 are attached at the of the frame, the bottom of the front covering 1206 can be connected to the floor 1203 by means of similar connection means (e.g., mating Velcro strips). The connection formed functions to create a secure radio-frequency barrier. An exemplary, completed system comprising an outer enclosure 200*b* and inner enclosure 200*a* (not shown) is depicted in FIG. 12Q.

Regarding the covering 1200 of an outer enclosure, it should be understood that the covering 1200 may cover the top and three sides of a frame (not the front), where the sides may be stitched to the top and connected to the floor 1203 with mated Velcro. Alternatively, the covering 1200 may cover the sides and be stitched or attached to the floor 1203 and may be configured to attach to the top using mated Velcro. Yet further, the covering 1200 may be stitched to a top covering (not shown in figures) of the frame. Still further a top covering may be stitched or attached by Velcro to the three side walls (i.e., not the front), while the sides are connected to the floor 1203 using Velcro.

In embodiments of the invention, the construction of an inner enclosure (or any enclosure) using a one-piece covering, such as enclosure 200*a* in FIG. 12A, may differ from the construction of an outer enclosure. For example, due to the use of a one-piece covering having an opening whose width is smaller than the overall width of a competed frame, the frame should be constructed by inserting one or more segments of the frame into the opening in the covering. In one embodiment, corner sections may first be inserted through the opening in a one-piece covering and then positioned in each of the corners of the covering to vertically support the covering while the remainder of the frame is constructed by inserting other elements (e.g., non-conductive beams) of the frame through the opening as well. Accordingly, in embodiments the corner sections may be configured in a size that will fit through the opening of a covering.

The description above provides some examples of the scope of the present invention. It is not intended to be an exhaustive description of the many examples of the invention. Such a description would be impractical to write. Variations of the examples given within are considered to be within the scope of the present invention.

The description above provides some examples of the scope of the present invention. It is not intended to be an exhaustive description of the many examples of the invention. Such a description would be impractical to write. Variations of the examples given within are considered to be within the scope of the present invention.

What is claimed is:

1. A system comprising a lightweight inner shielded enclosure and a lightweight outer shielded enclosure, wherein:

the lightweight inner enclosure comprises a plurality of non-conductive non-metallic beams forming an inner frame and a one-piece, first shielded fabric covering that distributes its weight over the inner frame to reduce forces on the first covering, wherein the beams forming the inner frame support the first covering; and the lightweight outer enclosure comprises a plurality of non-conductive non-metallic beams forming an outer frame, and a one-piece, second shielded fabric covering that distributes its weight over the outer frame to reduce forces on the second covering, wherein the beams forming the outer frame support the second covering, wherein a level of attenuation provided by the first shielded covering is different than a level of attenuation provided by the second shielded covering.

2. The system as in claim 1 further comprising a lightweight closure system that comprises a shielded fabric or a glidable wall.

3. The system as in claim 1 wherein a level of attenuation provided by the first shielded covering is the same as a level of attenuation provided by the second shielded covering.

4. The system as in claim 1 further comprising an active, acoustical masking system.

5. The system as in claim 1 wherein the first shielded covering comprises one or more layers configured to attenuate one or more EMI, RF, EMP and/or infrared signals and the second shielded covering comprises one or more layers configured to attenuate one or more EMI, RF, EMP and/or infrared signals.

6. The system as in claim 1 wherein the outer enclosure comprises a ballistic, nylon cover supported by the frame of the outer enclosure.

7. The system as in claim 1 wherein the inner enclosure comprises a first plurality of passive sound attenuation panels supported by the inner frame, wherein each passive sound attenuation panel comprises one or more layers of acoustical absorbing or reflective material.

8. The system as in claim 1 wherein the outer enclosure comprises a second plurality of passive sound attenuation panels supported by the outer frame, wherein each passive sound attenuation panel comprises one or more layers of acoustical absorbing or reflective material.

9. The enclosure as in claim 5 wherein a level of attenuation provided by each layer of each shielded covering is different.

10. The enclosure as in claim 1 wherein the inner enclosure further comprises a ballistic, nylon cover supported by the frame.

* * * * *